US011060371B2

(12) United States Patent
Moyes

(10) Patent No.: US 11,060,371 B2
(45) Date of Patent: Jul. 13, 2021

(54) JARRING APPARATUS

(71) Applicant: Rotojar Innovations Limited, Banchory Aberdeenshire (GB)

(72) Inventor: Peter Barnes Moyes, Aberdeenshire (GB)

(73) Assignee: Rotojar Innovations Limited, Aberdeenshire (GB)

( * ) Notice: Subject to any disclaimer, the term of this patent is extended or adjusted under 35 U.S.C. 154(b) by 0 days.

(21) Appl. No.: 16/963,024

(22) PCT Filed: Jan. 15, 2019

(86) PCT No.: PCT/GB2019/050102
§ 371 (c)(1),
(2) Date: Jul. 17, 2020

(87) PCT Pub. No.: WO2019/141974
PCT Pub. Date: Jul. 25, 2019

(65) Prior Publication Data

US 2020/0347689 A1 Nov. 5, 2020

(30) Foreign Application Priority Data

Jan. 19, 2018 (GB) ..... 1800895
Oct. 11, 2018 (GB) ..... 1816591

(51) Int. Cl.
*E21B 31/113* (2006.01)
*E21B 4/14* (2006.01)
*E21B 31/00* (2006.01)

(52) U.S. Cl.
CPC ..... *E21B 31/1135* (2013.01); *E21B 4/14* (2013.01); *E21B 31/005* (2013.01)

(58) Field of Classification Search
CPC ..... E21B 4/14; E21B 31/113; E21B 31/1135
See application file for complete search history.

(56) References Cited

U.S. PATENT DOCUMENTS 1,535,935 A 4/1925 McLean et al.
1,778,252 A 10/1930 Fentress
(Continued)

FOREIGN PATENT DOCUMENTS

WO WO-2014170686 A2 10/2014
WO WO-2017056026 A1 4/2017

OTHER PUBLICATIONS

International Search Report PCT/ISA/210 for International Application No. PCT/GB2019/050102 dated Apr. 12, 2019.
(Continued)

*Primary Examiner* — Shane Bomar
(74) *Attorney, Agent, or Firm* — Harness, Dickey & Pierce, P.L.C.

(57) ABSTRACT

A jarring apparatus includes first and second jarring assemblies rotatable relative to each other. A first impact surface is provided on the first jarring assembly and a second impact surface is provided on the second jarring assembly, wherein, in use, the first and second impact surfaces are biased together. A first lifting structure is rotatably fixed relative to the first jarring assembly and a second lifting structure is rotatably fixed relative to the second jarring assembly, the first and second lifting structures being configured to cooperate during relative rotation therebetween to cause cyclical relative displacement in one axial direction to define a lifting phase and relative displacement in a reverse axial direction to define a dropping phase. The first and second lifting structures are axially fixed relative to their associated jarring assembly during the lifting phase to provide axial separation between the first and second impact surfaces, and the second lifting structure is axially released relative to the second jarring assembly prior to initiation of the dropping phase to permit the first and second impact surfaces to be axially impacted together.

27 Claims, 13 Drawing Sheets

(56) References Cited

U.S. PATENT DOCUMENTS

| | | | | | |
|---|---|---|---|---|---|
| 1,901,513 | A * | 3/1933 | Harris | E21B 31/005 175/298 |
| 2,153,883 | A | 4/1939 | Foster | |
| 2,621,024 | A * | 12/1952 | Kopplleot | E21B 31/107 175/297 |
| 2,947,180 | A * | 8/1960 | Oros | B25D 11/106 173/97 |
| 3,139,933 | A * | 7/1964 | Golden | E21B 31/005 173/93 |
| 3,363,700 | A * | 1/1968 | Bogusch, Jr. | B25D 11/104 173/109 |
| 4,036,312 | A | 7/1977 | DeLuish | |
| 6,761,231 | B1 * | 7/2004 | Dock | E21B 4/10 175/107 |
| 7,882,906 | B1 | 2/2011 | Decuir, Sr. | |
| 9,624,725 | B2 * | 4/2017 | Cote | E21B 4/14 |
| 2018/0163474 | A1 * | 6/2018 | Kartha | E21B 4/10 |

OTHER PUBLICATIONS

Written Opinion of the International Searching Authority PCT/ISA/237 for International Application No. PCT/GB2019/050102 dated Apr. 12, 2019.
Great Britain Office Action 1800895.3 dated Jun. 11, 2018.
Great Britain Office Action 1816591.0 dated Apr. 17, 2019.
International Report on Patentability and Written Opinion for PCT/GB2019/050102 dated Jul. 30, 2020.

* cited by examiner

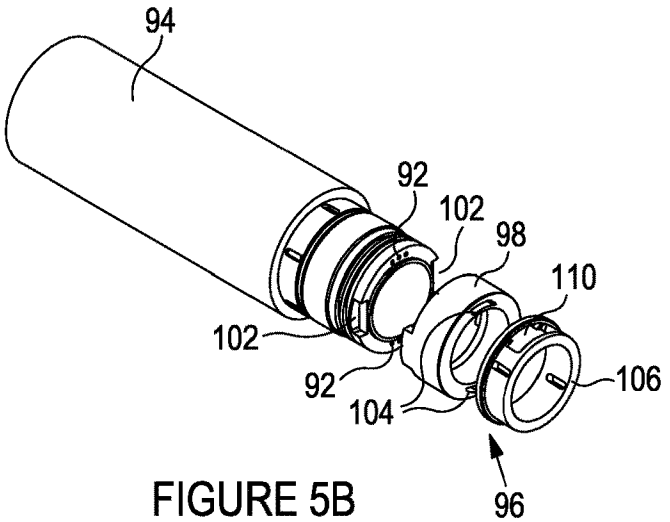
FIGURE 5A
FIGURE 5B
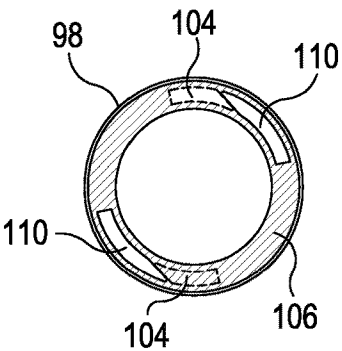
FIGURE 6A
FIGURE 6B
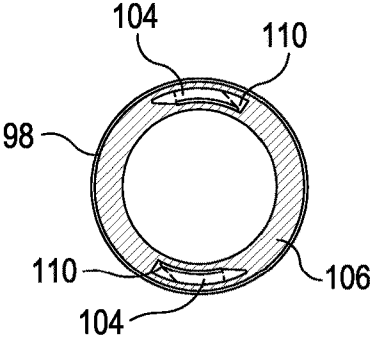
FIGURE 6C
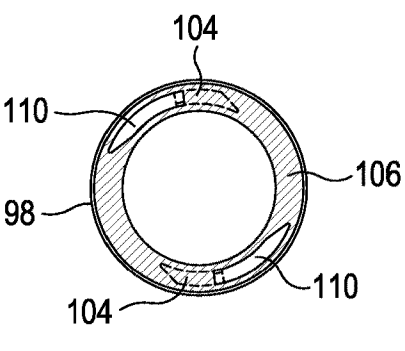
FIGURE 6D 16
432
434
23B
436
474
496
480
420
422
428
414
412
410

434
438
436
448
432

474
510
504
504
480
496

432
434
24B
436
496
420
422
428
414
412
410

434
438
436
448
432

510
504
496

JARRING APPARATUS

CROSS-REFERENCE TO RELATED APPLICATIONS

This application is a national phase under 35 U.S.C. § 371 of PCT International Application No. PCT/GB2019/050102 which has an International filing date of Jan. 15, 2019, which claims priority to Great Britain Application Nos. 1800895.3, filed Jan. 19, 2018 and 1816591.0, filed Oct. 11, 2018, the entire contents of each of which are hereby incorporated by reference.

FIELD

The present disclosure relates to a jarring apparatus and associated methods.

BACKGROUND

Many industries require the application of jarring forces to support certain operations. For example, in the oil and gas exploration and production industry jarring tools might be used downhole to apply jarring to a stuck object, such as a stuck tool, drill bit, drill string, bottom hole assembly (BHA) and the like. Further, it might be desirable to apply jarring forces during the process of drilling, for example to apply a hammer drilling effect, and/or be available in the event of a drill bit or string becoming stuck. Other jarring applications may include piling, for example.

Generally, a jarring tool is a device used to deliver an impact load to another component such as a BHA. Known jarring tools operate by storing energy, such as in a drilling string, for example by applying tension within the string, and suddenly releasing this energy to cause two impact surfaces to move axially and strike each other, creating an impact or jarring force.

Jarring tools are known which operate in response to a linear activation input, and are thus typically known as linear jarring tools.

Proposals have also been made concerning jarring tools which can provide a linear jar in response to a rotational drive input, such as from a drill string. In some proposals "rotary jarring" is provided by interaction of opposing rotary cams each having inter-engaging ramp profiles which gradually increase in a rotational direction until reaching a peak. During relative rotation of the cams the ramped surfaces interact to achieve relative axial displacement, and once the opposing cams peak they effectively drop-off and impact together, thus generating a jarring force.

While such rotary jarring can in some instances provide benefits over linear jarring concepts, some problems may arise. For example, the nature of the cam surfaces is such that as the cams approach their peak displacement the contact surface area reduces which can generate very significant stresses within the cams, theoretically tending to infinity at the drop-off point. Further, the cams themselves are subject to direct impact contact therebetween. As such, the cams may be subject to failure.

SUMMARY

An aspect of the present disclosure relates to a jarring apparatus, comprising:

first and second jarring assemblies rotatable relative to each other;

a first impact surface provided on the first jarring assembly and a second impact surface provided on the second jarring assembly, wherein, in use, the first and second impact surfaces are biased together; and a first lifting structure rotatably and axially fixed relative to the first jarring assembly and a second lifting structure rotatably and axially fixed relative to the second jarring assembly, the first and second lifting structures being configured to cooperate during relative rotation therebetween to provide relative axial displacement therebetween to provide axial separation between the first and second impact surfaces, wherein the second lifting structure is axially releasable relative to the second jarring assembly to permit the first and second impact surfaces to be axially impacted together.

An aspect of the present disclosure relates to a jarring apparatus, comprising:

first and second jarring assemblies rotatable relative to each other;

a first impact surface provided on the first jarring assembly and a second impact surface provided on the second jarring assembly, wherein, in use, the first and second impact surfaces are biased together; and a first lifting structure rotatably fixed relative to the first jarring assembly and a second lifting structure rotatably fixed relative to the second jarring assembly, the first and second lifting structures being configured to cooperate during relative rotation therebetween to cause cyclical relative displacement in one axial direction to define a lifting phase and relative displacement in a reverse axial direction to define a dropping phase, wherein the first and second lifting structures are axially fixed relative to their associated jarring assembly during the lifting phase to provide axial separation between the first and second impact surfaces, and the second lifting structure is axially released relative to the second jarring assembly prior to initiation of the dropping phase to permit the first and second impact surfaces to be axially impacted together.

In use, relative rotation between the first and second jarring assemblies generates jarring forces within the jarring apparatus by repeated axial impact between the first and second impact surfaces. The generation of jarring forces by rotational movement may permit multiple jarring events to be achieved by continuous relative rotation between the first and second jarring assemblies.

As the jarring effect is achieved by a rotational drive movement, the apparatus may be defined as a rotary jarring apparatus. Furthermore, as the jarring effect is achieved by a rotational movement, rather than a solely relative linear motion, problems associated with prior art linear jars may be at least partially addressed.

At least one of the first and second jarring assemblies may be engaged with an object such that the jarring forces generated within the jarring apparatus may be applied to said object. The object may comprise anything which might require the application of a jarring force, such as to deploy the object, retrieve the object, free the object when stuck, activate the object, install the object, drive the object and/or the like.

The impact surfaces are axially separated by rotary interaction between the first and second lifting structures, and permitted to axially impact together by virtue of axially releasing the second lifting structure. Accordingly, impact between the first and second impact surfaces is not initiated or caused by transition of the lifting structures to the dropping phase, thus affording protection to the lifting structures and contributing to addressing or at least mitigating problems associated with prior art rotary jarring tools. This may assist to prolong the operational life of the lifting structures.

The dropping phase of the first and second lifting structures may be considered to function to reset the lifting structures in preparation for a subsequent lifting phase.

Following axial release of the second lifting structure the bias applied between the first and second impact surfaces will drive, for example rapidly drive, said surfaces together, thus generating an impact force. Providing the impact surfaces separately or remotely from the lifting structures may afford protection to the lifting structures, assisting to prolong the life of the lifting structures.

Separation of the impact surfaces may generate potential energy therebetween, wherein upon axial release of the second lifting structure said potential energy is rapidly released to drive the first and second impact surfaces together. The potential energy generated may be a function of the bias applied between the first and second impact surfaces when the jarring apparatus is in use.

In some applications loading between the first and second jarring assemblies during the lifting phase may be increased as the displacement between the first and second lifting structures increases. This may provide an increase in potential energy between the jarring assemblies. However, in other applications any increased loading during the lifting phase may be negligible.

Loading between the first and second jarring assemblies may be permitted to be applied between the first and second lifting structures when the second lifting structure is axially fixed relative to the second jarring assembly.

The first lifting structure may be axially fixed relative to the first jarring assembly at least in the direction of the applied loading. Such an arrangement may prevent the first lifting structure from moving axially relative to the first jarring assembly caused by loading applied between the first and second lifting structures.

The second lifting structure, when axially fixed relative to the second jarring assembly may be axially fixed at least in the direction of the applied loading between the first and second lifting structures. Such an arrangement may prevent the second lifting structure, when axially fixed relative to the second jarring assembly, from moving axially relative to the second jarring assembly caused by loading applied between the first and second lifting structures.

Axial release of the second lifting structure may function to release or reduce, for example significantly reduce, loading applied between the first and second lifting structures prior to initiation of the dropping phase. This arrangement may assist to minimise wear and/or risk of damage or failure occurring within the lifting structures.

The second lifting structure may remain axially released relative to the second jarring assembly during a transition from the lifting phase to the dropping phase. In some examples the second lifting structure may remain axially released relative to the second jarring assembly during at least a portion, for example the entirety of the dropping phase. Accordingly, the dropping phase may be initiated and optionally completed with minimised loading applied between the first and second lifting structures, which may assist to provide protection to the lifting structures and prolong their operational lifespan.

The second lifting structure may become axially fixed relative to the second jarring assembly in advance of a subsequent lifting phase. The second lifting structure may become axially fixed relative to the second jarring assembly upon initiation of a subsequent lifting phase. The second lifting structure may become axially fixed relative to the second jarring assembly during the course of a subsequent lifting phase.

In some examples the second lifting structure may be axially released relative to the second jarring assembly prior to completion of the lifting phase. In such an arrangement relative axial displacement between the first and second lifting structures may continue under reduced loading to complete the lifting phase.

The first and second lifting structures may comprise inter-engaging profiles which cooperate during relative rotation of the lifting structures to cause the cyclical lifting and dropping phases. The inter-engaging profiles may be configured such that a surface area of contact therebetween reduces as the lifting phase progresses. When exposed to load such a reducing surface area of contact results in increasing stresses applied between the inter-engaging profiles of the first and second lifting structures. As such, axially releasing the second lifting structure prior to completion of the lifting phase may prevent excessive loading being applied over the reducing surface area of contact, reducing stresses applied and minimising wear and risk of damage or failure.

In some examples the timing of the axial release of the second lifting structure may be adjustable. Such adjustment may be achieved prior to deployment and use of the jarring apparatus. In some examples, such adjustment may be achieved while the jarring apparatus is deployed and/or in use.

The inter-engaging profiles may permit at least one cycle of lifting and dropping phases for a single 360 degrees of relative rotation between the first and second lifting structures. In one example the inter-engaging profiles may permit multiple cycles (such as 2, 3, 4 etc.) of lifting and dropping phases for a single 360 degrees of relative rotation.

The inter-engaging profiles may be configured for rotating sliding engagement therebetween. The inter-engaging profiles may be defined by circumferential ramp structures. In one example the inter-engaging profiles may comprise rotary cam surfaces. In such examples the first and second lifting structures may define respective first and second lifting cams. The number of individual cam profiles provided on each lifting structure may dictate the number of lifting and dropping phases provided for a single 360 degrees of relative rotation between the lifting structures.

The inter-engaging profiles may comprise or be defined by a track and follower arrangement.

The inter-engaging profiles of the first and second lifting structures may be prevented from axial impact during or following the dropping phase. Such an arrangement may function to minimise wear and/or damage to the inter-engaging profiles. In one example one or both of the first and second lifting structures may comprise a no-go profile which functions to prevent axial impact of the inter-engaging profiles following the dropping phase. In some examples the second lifting structure may include a no-go profile, such as an annular lip, ring or the like, configured to interact with the second jarring assembly to prevent axial impact between the inter-engaging profiles of the first and second lifting structures.

The inter-engaging profiles may remain separated during a portion of relative rotation between the first and second lifting structures following the dropping phase. Such relative rotation without contact may define a transition phase between the dropping phase and a subsequent lifting phase.

The inter-engaging profiles may be brought into contact during relative rotation to initiate a subsequent lifting phase.

The first lifting structure may be permanently axially fixed relative to the first jarring assembly, at least in a direction of loading applied between the first and second lifting structures. In such an example the first lifting structure may be defined as a fixed lifting structure. In an alternative example the first lifting structure may be axially releasable relative to the first jarring assembly.

The second lifting structure by being axially releasable relative to the second jarring assembly may be defined as a shuttle lifting structure.

The lifting phase may be achieved during a first relative rotational displacement between the first and second lifting structures.

The dropping phase may be achieved substantially instantaneously upon completion of the lifting phase. For example, the first and second lifting structures may define an axial drop-off profile such that when a defined relative rotational alignment between the lifting structures is achieved the lifting structures may initiate relative axial displacement in the direction of the dropping phase.

Alternatively, the dropping phase may be achieved during a second relative rotational displacement between the first and second lifting structures. For example, one or both of the first and second lifting structures may define a dropping ramp profile which requires a degree of relative rotation between the first and second lifting structures to allow the lifting structures to complete the dropping phase.

The first and second lifting structures may collectively define a lifting mechanism forming part of the jarring apparatus.

One of the first and second jarring assemblies may extend into the other of the first and second jarring assemblies. In some examples the first and second jarring assemblies may be coaxially aligned with each other. In other examples the first and second jarring assemblies may be eccentrically aligned relative to each other.

The first and second lifting structures may be interposed, for example radially interposed between the first and second jarring assemblies. In one example, the first and second lifting structures may be positioned within a radial space, such as an annular space defined between the first and second jarring assemblies.

The jarring apparatus may comprise a locking system for selectively axially fixing and releasing the second lifting structure relative to the second jarring assembly. The locking system may be operated by relative rotational movement between the first and second jarring assemblies. Operating the first and second lifting structures and also the locking system by the relative rotation between the first and second jarring assemblies may facilitate simplified establishing of appropriate sequencing or timing of the lifting and dropping phases and the fixing and releasing of the second lifting structure. In this respect, a common datum of the relative positioning of the first and second jarring assemblies may be utilised.

In some examples the locking system may be operable in response to relative axial displacement of the first and second lifting structures, wherein said relative axial displacement is provided in response to relative rotation between the lifting structures.

The locking system may comprise a mechanical locking system for mechanically locking and releasing the second lifting structure relative to the second jarring assembly. The mechanical locking system may comprise a mechanical latch or the like.

The locking system may comprise a hydraulic locking system for hydraulically locking and releasing the second lifting structure relative to the second jarring assembly. The hydraulic locking system may be interposed, for example radially interposed, between the first and second jarring assemblies.

The hydraulic locking system, when locked, may hydraulically lock or trap a volume of hydraulic fluid (e.g., incompressible) axially between the second lifting structure and the second jarring assembly. Accordingly, axial forces may be transmitted between the second lifting structure and second jarring assembly via the hydraulically locked fluid.

The hydraulic locking system may release the hydraulically locked fluid to permit axial release of the second lifting structure relative to the second jarring assembly. Such release of the hydraulic lock may thus permit the second lifting structure to move axially relative to the second jarring assembly. The hydraulic fluid may be released to a fluid source (e.g., a fluid reservoir, flow path through the jarring apparatus etc.). The hydraulic fluid may be pressure relieved, for example pressure balanced, relative to the fluid source.

Selective trapping and release of the hydraulic fluid may be achieved in accordance with relative rotation between the first and second jarring assemblies.

The hydraulic locking system may comprise a first hydraulic chamber, wherein hydraulic fluid may be hydraulically locked within said first hydraulic chamber to hydraulically lock the second lifting structure relative to the second jarring assembly. The first hydraulic chamber may be at least partially defined between, for example axially between, the second lifting structure and the second jarring assembly. The first hydraulic chamber may be at least partially defined between, for example radially between, the first and second jarring assemblies. At least a portion of the first hydraulic chamber may be generally annular in form. For example, at least a portion of the first hydraulic chamber may be defined in an annular space between the first and second jarring assemblies.

The hydraulic locking system may comprise a valve assembly which is closed to hydraulically lock the fluid within the first hydraulic chamber, and which is opened to release the hydraulically locked fluid. The valve assembly may be configurable between open and closed configurations in response to relative rotation between the first and second jarring assemblies. Such hydraulic locking and unlocking by the valve assembly may be cyclical in accordance with relative rotation between the first and second jarring assemblies. In some examples the frequency of opening and closing of the valve assembly may be linked to the frequency of jarring.

The first hydraulic chamber may extend between the second lifting structure and the valve assembly. When the valve assembly is in its closed position the fluid within the first hydraulic chamber may become trapped therein, thus hydraulically locking the second lifting structure relative to the second jarring assembly.

The jarring apparatus may comprise a biasing arrangement within the first hydraulic chamber which acts against, directly or indirectly, the second lifting structure. Such an arrangement may function to bias the second lifting structure towards the first lifting structure. Such a bias may facilitate or provide appropriate force to drive or hold the first and second lifting structures together during the dropping phase. Such a bias may function to assist in re-setting the apparatus (i.e., to drive the dropping phase). The valve assembly may be configured to open and close communication (e.g., fluid and/or pressure communication) between the first hydraulic chamber and a fluid source to provide hydraulic locking and release of the second lifting structure.

The hydraulic locking system may comprise a second hydraulic chamber which defines the fluid source. In this example the valve assembly may be interposed between the first and second hydraulic chambers such that when the valve assembly is closed the first and second chambers may be isolated from each other (to provide the hydraulic lock), and when the valve assembly is open the first and second chambers may be presented in communication with each other (to release the hydraulic lock).

The second hydraulic chamber may define a hydraulic reservoir, facilitating flow of hydraulic fluid to/from the first hydraulic chamber when the valve assembly is opened. Such flow to/from the first hydraulic chamber may be in accordance with the lifting and dropping phases of the first and second lifting structures. That is, when the valve assembly is opened and the first and second lifting structures are in their lifting phase, hydraulic fluid may be displaced from the first fluid chamber to the second fluid chamber, and when the first and second lifting structures are in their dropping phase hydraulic fluid may move from the second fluid chamber to the first fluid chamber in preparation to provide a hydraulic lock for a subsequent lifting phase when the valve assembly is closed.

In one example the second hydraulic chamber may be defined by a flow path within the jarring apparatus. As such, the second hydraulic chamber may not be defined by a closed space. In this example hydraulic fluid for use in the hydraulic locking system may be obtained from fluid flowing within the jarring apparatus. The fluid flowing within the jarring apparatus may be provided exclusively for use within the hydraulic locking apparatus, for example exclusively as the hydraulic locking fluid. Alternatively, the fluid flowing through the jarring apparatus may provide a separate or additional function, for example associated with wellbore operations, such as drilling or the like. In some examples the fluid may comprise drilling fluid, drilling mud, hydraulic oil, water or the like.

The flow path may extend through the jarring apparatus, for example axially through the jarring apparatus. The flow path may define at least one port to permit communication with the first fluid chamber in accordance with the configuration of the valve assembly. In some examples the at least one port may form part of the valve assembly.

In one example the second hydraulic chamber may be defined by a flow path extending through the first jarring assembly, for example through a mandrel of the first jarring assembly.

The second hydraulic chamber may be provided within a space defined within the jarring apparatus. In one example the second hydraulic chamber may extend between the valve assembly and a moveable barrier. The moveable barrier may permit the volume of the second hydraulic chamber to be varied in accordance with the flow of hydraulic fluid into and from the second hydraulic chamber when the valve assembly is opened. The moveable barrier may comprise a floating piston member. The moveable barrier member may comprise a flexible membrane.

In some examples the moveable barrier may absorb or dampen hydraulic shock loading when the hydraulically locked fluid is released upon the valve assembly becoming opened. Further, the moveable barrier may function to accommodate thermal expansion of the hydraulic fluid.

The moveable barrier member may be biased in a direction to reduce the volume of the second hydraulic chamber. Such an arrangement may seek to displace hydraulic fluid from the second fluid chamber into the first fluid chamber when the valve assembly is open. Such an arrangement may function to bias the second lifting structure towards the first lifting structure when the second lifting structure is axially released relative to the second jarring assembly (i.e., when the valve assembly is open). Such a bias may facilitate or provide appropriate force to drive or hold the first and second lifting structures together during the dropping phase. Such a bias may function to assist in re-setting the apparatus (i.e., to drive the dropping phase).

The moveable barrier member may be spring biased.

An opposing side of the moveable barrier (i.e., opposing to the side exposed to the second hydraulic chamber) may be exposed to ambient pressure, such that said ambient pressure may act to bias the moveable barrier in a direction to reduce the volume of the second hydraulic chamber. The opposing side of the moveable barrier may be directly exposed to ambient fluid, and thus ambient pressure. Alternatively, the opposing side of the moveable barrier may be exposed to a clean fluid, wherein a pressure transfer arrangement is provided to transfer pressure between ambient fluid and the clean fluid. Such an arrangement may minimise the possibility of the apparatus being compromised by debris etc. within ambient fluid. The opposing side of the moveable barrier may be exposed to pressure within the apparatus.

In some examples the second lifting structure may be exposed to ambient pressure. Exposing the moveable barrier and the second lifting structure to a common ambient pressure may function to provide a pressure balance within the apparatus. This may assist to ensure the dropping phase is achieved and suitable resetting between the lifting structures is provided. The second lifting structure may be directly exposed to ambient fluid, and thus ambient pressure. Alternatively, the second lifting structure may be exposed to a clean fluid, wherein a pressure transfer arrangement is provided to transfer pressure between ambient fluid and the clean fluid. The second lifting structure may be exposed to pressure within the apparatus.

The valve assembly may comprise a first valve portion rotatably fixed relative to the first jarring assembly and a second valve portion rotatably fixed relative to the second jarring assembly such that relative rotation between the first and second jarring assemblies causes corresponding relative rotation between the first and second valve portions.

At least one of the first and second valve portions may be provided as part of, for example an integral part of, their associated jarring assembly.

In one example the first valve portion may be provided as part of, for example an integral part of the first jarring assembly. For example, the first valve portion may be provided as part of the mandrel of the first jarring portion.

At least one of the first and second valve portions may be separately formed and rotatably fixed relative to their associated jarring assembly by any suitable connection, such as a splined connection, keyed connection, castellated connection and/or the like.

In one example the second valve portion may be coupled to (e.g., via a suitable connection, by integrally forming or the like) the second lifting structure, thus permitting said second lifting structure to be rotatably coupled to the second jarring assembly via the second valve portion.

The first and second valve portions may be engaged with each other. The first and second valve portions may be configured for sliding engagement during relative rotation therebetween. In some examples the first and second valve portions may be axially engaged with each other, for example via axially engaging faces. In some examples the first and second valve portions may be radially or circumferentially engaged with each other, for example via radial (e.g., circumferential) surfaces.

In some examples the first and second valve portions may be biased, for example axially biased into engagement with each other, for example via a spring biasing arrangement.

The first and second valve portions may each comprise at least one port, wherein the ports are sequentially aligned and misaligned during relative rotation between the first and second valve portions to sequentially establish and prevent fluid communication between the first and second hydraulic chambers. The at least one port of each valve portion may be provided on or in a respective axial surface of the associated valve portion. The at least one port of each valve portion may be provided on or in a respective circumferential surface of the associated valve portion.

The valve assembly may define a rotary gate valve. The valve assembly may define a rotary plug valve.

In some examples the number of ports in each valve portion may be linked to the jarring frequency of the apparatus in use.

The timing of the alignment and misalignment of the ports may be related to the required timing of the axial release of the second lifting structure and the lifting and dropping phases of the first and second lifting structures. The initial relative rotational position of the first and second valve portions may dictate the timing of opening and closing of the valve assembly.

The ports may define a geometry or profile which facilitates a preferred increase of flow area therethrough during the course of being aligned. In some examples each port may define a leading portion defining a tapering profile, which increases during rotational alignment of respective ports. Such a tapering profile may facilitate a gradual increase in flow area, which may provide benefits such as minimising or damping shock loading upon initial release of the hydraulically locked fluid.

In some examples each port may be profiled to rapidly increase flow area. This may provide benefits, such as avoiding fluid dampening and increase fluid flow to allow as high an impact as possible.

The first and second valve portions may be configured to provide complete sealing therebetween when the ports are misaligned. However, in some examples some degree of leakage may be tolerated. Such leakage may function to lubricate engaging surfaces of the first and second valve portions.

In some examples the hydraulic locking system may comprise a pressure relief system, such as a pressure relief valve, to prevent pressure therein from exceeding a threshold. Such an arrangement may minimise the risk of damage within the apparatus in the event of excessive application of bias between the first and second jarring assemblies.

The first and second lifting structures may be rotatably coupled to their associated jarring assembly in any suitable manner, for example via a splined connection, keyed connection and/or the like.

In one example the second lifting structure may be coupled to the second jarring assembly via a rotary coupling which permits relative axial movement therebetween. In such an arrangement the second lifting structure may remain rotatably coupled relative to the second jarring assembly when the second lifting structure is axially released relative to the second jarring assembly. In one example a castellated connection may be provided between the second lifting structure and the second jarring assembly. As noted above, in one example the second lifting structure may be rotatably coupled to the second jarring assembly via a valve portion of a valve assembly.

One of the first and second impact surfaces may be defined on a hammer, and the other of the first and second impact surfaces may be defined on an anvil. One or both of the hammer and anvil may be replaceable. The first and second impact surfaces may comprise a suitable material to accommodate repeated impact forces therebetween. In some examples a bearing steel may be utilised.

The first and/or second impact surface may or may not be rotatably fixed relative to their associated jarring assembly.

The first and second impact surfaces may be provided within or exposed to a fluid which functions to cool and/or lubricate the impact surfaces during operation. The first and second impact surfaces may be exposed to a fluid provided via a flow path internally within the jarring apparatus. The first and second impact surfaces may be exposed to ambient fluid which functions to cool and/or lubricate the impact surfaces. In some examples the first and second impact surfaces may be provided within a flow path, such that a fluid may flow or circulate therethrough. In examples where the jarring apparatus may be used in a downhole environment, the impact surfaces may be exposed to a downhole fluid, such as an annulus fluid. The impact surfaces may be provided within a circulation path between a wellbore annulus region and a flow path internally within the jarring apparatus.

In some examples the impact surfaces may be provided within a clean environment, isolated from downhole fluids.

One of the first and second jarring assemblies may comprise a mandrel, and the other of the first and second jarring assemblies may comprise a housing assembly. The mandrel may extend at least partially within the housing assembly. The mandrel may be composed of a unitary or multiple components. Similarly, the housing assembly may be composed of unitary or multiple components.

The first and second jarring assemblies may be rotatable relative to each other when configured in a first mode of operation. Such a first mode of operation may be defined as a jarring mode of operation. The first and second jarring assemblies may be rotatably fixed relative to each other when configured in a second mode of operation. Such a second mode of operation may be defined as a deactivated or non-jarring mode of operation.

When the first and second jarring assemblies are configured in the second (non-jarring) mode of operation torque may be transmitted therebetween. This may facilitate certain operations, such as drilling operations and the like. For example, in a downhole drilling application torque may be transmitted between the first and second jarring assemblies from a drill or work string coupled on one side of the jarring apparatus to a BHA coupled on an opposite side of the jarring apparatus.

The jarring assemblies may be reconfigured between the first and second modes of operation by relative axial movement therebetween. Relative axial movement to configure the first and second jarring assemblies in their first (jarring) mode of operation may bring the first and second lifting structures and the first and second impact surfaces into proximity to thus operate as required upon relative rotation between the first and second jarring assemblies.

The apparatus may comprise a releasable axial locking mechanism arranged between the first and second jarring assemblies. The releasable axial locking mechanism may be released when the first and second jarring assemblies are, or are to be, configured in the first (jarring) mode of operation, and locked when the first and second jarring assemblies are configured in the second (non-jarring) mode of operation.

The releasable axial locking mechanism may be releasable upon application of a predetermined axial force applied between the first and second jarring assemblies. The predetermined axial force may be non-zero.

The releasable axial locking mechanism may be resettable.

The releasable axial locking mechanism may comprise a mechanical locking mechanism. The releasable axial locking mechanism may comprise a fluid locking system, such as hydraulic locking mechanism.

The apparatus may comprise a rotatable locking mechanism arranged between the first and second jarring assemblies for rotatably locking the first and second jarring assemblies when configured in the second (non-jarring) mode of operation. The rotatable locking mechanism may be releasable to permit the first and second jarring assemblies to be configured in the first (jarring) mode of operation. The rotatable locking mechanism may be resettable to permit reconfiguration of the first and second jarring assemblies to the second (non-jarring) mode of operation. The rotatable mechanism may be releasable and resettable by providing relative axial movement between the first and second jarring assemblies.

The rotatable locking mechanism may comprise, for example, a spline arrangement, key arrangement and/or the like.

In some examples the jarring apparatus may be for use within a wellbore. As such, the jarring apparatus may define a downhole jarring apparatus. The jarring apparatus may be configured to apply a jarring force to a pipe string, downhole tool, bottom hole assembly (BHA), such as a drilling BHA, or the like. The jarring apparatus may be configured for use in releasing an object which is stuck within a wellbore. In some examples the jarring apparatus may be deployable downhole on an elongate medium, such as wireline, coiled tubing, jointed tubing or the like. The jarring apparatus may be tractor deployed downhole.

The jarring apparatus may be configured for use in pulling plugs within a wellbore or associated infrastructure.

The jarring apparatus may be configured for use in pulling or retrieval operations associated with removal of infrastructure from a wellbore, such as pulling completions, casing, liner, conductor and the like.

The jarring apparatus may be configured for use in subsea applications, such as in piling applications, equipment removal applications, and the like.

The apparatus may be configured to permit axial jarring in one axial direction, such as in an upward or downward direction. The apparatus may be configured to permit axial jarring in opposing axial directions, such as both upwardly and downwardly.

The rotatable jarring arrangement may be configured to receive rotational drive movement from a rotational drive mechanism. The rotational drive mechanism may be configured separately from the apparatus. Alternatively, or additionally, the apparatus may comprise a rotational drive mechanism.

The rotational drive mechanism may be coupled or otherwise associated with at least one of the first and second jarring assemblies and configured to provide a relative rotational movement therebetween.

The rotational drive mechanism may comprise a rotatable work string coupled to at least one of the first and second jarring assemblies. The work string may be defined by, for example, a drilling string.

The rotational drive mechanism may comprise a motor, such as an electric motor, pneumatic motor, hydraulic motor, mud motor or the like.

An aspect of the present disclosure relates to a method for providing jarring, comprising:

providing a jarring apparatus which includes a first jarring assembly having a first impact surface and a first lifting structure rotatably and axially fixed relative to the first jarring assembly, and a second jarring apparatus having a second impact surface and a second lifting structure rotatably fixed relative to the second jarring assembly;

axially fixing the second lifting assembly relative to the second jarring assembly;

establishing relative rotational movement between the first and second jarring assemblies to cause corresponding relative rotational movement between first and second lifting structures which cooperate to cause relative axial displacement in a lifting phase to cause axial separation between the first and second impact surfaces; and axially releasing the second lifting structure relative to the second jarring assembly to permit the first and second impact surfaces to be axially impacted together.

Axially releasing the second lifting structure may be performed by relative rotation between the first and second lifting structures.

The method may comprise, following axially releasing the second lifting structure, continuing relative rotational movement between the first and second jarring assemblies to cause reverse relative axial displacement in a dropping phase. Such a dropping phase may permit resetting of the first and second lifting assemblies.

The method may comprise subsequently axially fixing the second lifting assembly relative to the second jarring assembly such that continued relative rotation between the first and second jarring assemblies causes a subsequent lifting phase between the first and second lifting structures and corresponding axial separation of the first and second impact surfaces.

Axially fixing the second lifting structure may be performed by relative rotation between the first and second lifting structures.

The method may comprise continuing relative rotational movement between the first and second jarring assemblies to cause cyclical lifting and dropping phases and axial fixing and release of the second lifting assembly to generate multiple impacts between the first and second impact surfaces.

The method may be performed using a jarring apparatus according to any other aspect.

An aspect of the present disclosure relates to a hydraulic locking system, comprising:

first and second relative rotatable bodies;

a lockable component positioned in a radial space between the first and second bodies;

a first hydraulic chamber defined between the first and second relative rotatable bodies and the lockable component; and a valve assembly interposed between the first and second relative rotatable bodies and being configurable during relative rotation between the first and second rotatable bodies to cycle between open and closed configurations, wherein in the closed configuration hydraulic fluid is trapped within the first hydraulic chamber to hydraulically lock the lockable component, and in the open configuration hydraulic fluid can be released form the first hydraulic chamber to release the lockable component.

Accordingly, the lockable component may be cyclically locked and unlocked during continued relative rotation between the first and second rotatable bodies.

The lockable component may be axially locked and released relative to one of the first and second bodies.

Such cyclical locking and unlocking may be timed to coincide with an associated operation, such as an operation to generate cyclical jarring forces, such as within a jarring apparatus.

The valve assembly may comprise a first valve portion rotatably fixed relative to the first body and a second valve portion rotatably fixed relative to the second body such that relative rotation between the first and second bodies causes corresponding relative rotation between the first and second valve portions. The first and second valve portions may be rotatably fixed relative to their associated body by any suitable connection, such as by integrally forming, a splined connection, keyed connection, castellated connection and/or the like.

The first and second valve portions may be engaged with each other. The first and second valve portions may be configured for sliding engagement during relative rotation therebetween. In some examples the first and second valve portions may be axially engaged with each other, for example via axially engaging faces. In some examples the first and second valve portions may be radially or circumferentially engaged with each other, for example via circumferential surfaces.

In some examples the first and second valve portions may be biased, for example axially biased into engagement with each other, for example via a spring biasing arrangement.

The first and second valve portions may each comprise at least one port, wherein the ports are sequentially aligned and misaligned during relative rotation between the first and second bodies to sequentially permit and prevent fluid release from the first hydraulic chambers. The at least one port of each valve portion may be provided on or in a respective axial surface of the associated valve portion. The at least one port of each valve portion may be provided on or in a respective circumferential surface of the associated valve portion.

The valve assembly may define a rotary gate valve. The valve assembly may define a rotary plug valve.

The ports may define a geometry or profile which facilitates a preferred increase of flow area therethrough during the course of being aligned. In some examples each port may define a leading portion defining a tapering profile, which increases during rotational alignment of respective ports. Such a tapering profile may facilitate a gradual increase in flow area, which may provide benefits such as minimising or damping shock loading upon initial release of the hydraulically locked fluid from the first hydraulic chamber.

The first and second valve portions may be configured to provide complete sealing therebetween when the ports are misaligned. However, in some examples some degree of leakage may be tolerated. Such leakage may function to lubricate engaging surfaces of the first and second valve portions.

In one example the hydraulic locking system may comprise a second hydraulic chamber, wherein the valve assembly is interposed between the first and second hydraulic chambers. When the valve assembly is closed the first and second chambers may be isolated from each other (to provide the hydraulic lock), and when the valve assembly is open the first and second chambers may be presented in communication with each other.

The second hydraulic chamber may define a hydraulic reservoir, facilitating flow of hydraulic fluid to/from the first hydraulic chamber when the valve assembly is opened.

The second hydraulic chamber may be defined by a flow path. The flow path may extend through one of the first and second relative rotatable bodies.

The second hydraulic chamber may be defined between the first and second bodies. The second hydraulic chamber may extend between the valve assembly and a moveable barrier. The moveable barrier may permit the volume of the second hydraulic chamber to be varied in accordance with the flow of hydraulic fluid into and from the second hydraulic chamber when the valve assembly is opened. The moveable barrier may comprise a floating piston member. The moveable barrier member may comprise a flexible membrane.

In some examples the moveable barrier may absorb or dampen hydraulic shock loading when the hydraulically locked fluid is released upon the valve assembly becoming opened.

The moveable barrier member may be biased in a direction to reduce the volume of the second hydraulic chamber. Such an arrangement may seek to displace hydraulic fluid from the second fluid chamber into the first fluid chamber when the valve assembly is open. Such an arrangement may function to bias the lockable component towards a desired position in which the lockable component is to be locked.

The moveable barrier and the lockable component may be pressure balanced. For example the moveable barrier and the lockable component may be exposed to a common pressure source.

An aspect of the present disclosure relates to a method for cyclically locking and releasing a component using the hydraulic locking apparatus of any other aspect.

It should be understood that the features defined in relation to one aspect may be applied in relation to any other aspect.

BRIEF DESCRIPTION OF THE DRAWINGS

Aspects of the present disclosure will now be exemplified with reference to the accompanying drawings, in which:

FIG. 5A is a perspective view of a rotary gate valve of the jarring apparatus of FIG. 1A;

FIG. 5B is an exploded view of the rotary gate valve of FIG. 5A;

FIGS. 6A to 6D diagrammatically illustrate stages of opening and closing of the rotary gate valve of FIG. 5A;

FIGS. 7A to 12C illustrate the jarring apparatus of FIG. 1A in sequential stages of operation;

FIGS. 19A to 24C illustrate the jarring apparatus of FIG. 16A in sequential stages of operation.

DETAILED DESCRIPTION OF THE DRAWINGS

Aspects of the present disclosure relate to a jarring apparatus. Such a jarring apparatus may be used in any application which requires the application of a jarring force. For the purposes of the present exemplary description a jarring apparatus for use within a wellbore is described. However, this is not limiting, and the principles of the present disclosure may be applied in any jarring application, which may or may not be utilised in a wellbore.

Figure 1A:
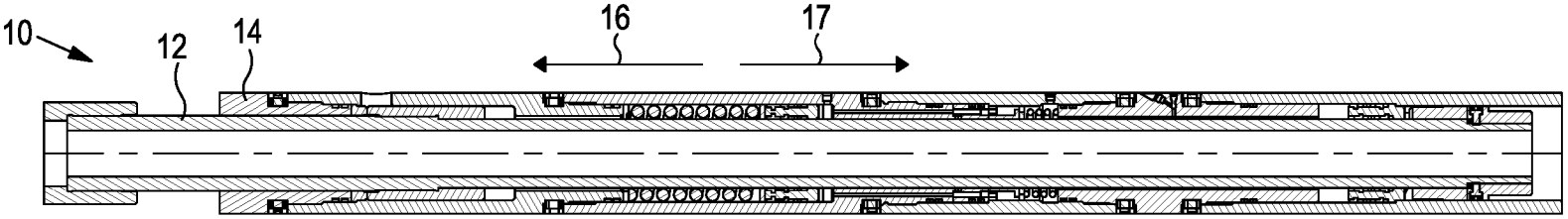
FIG. 1A is a longitudinal cross-sectional view of a jarring apparatus.

A jarring apparatus, generally identified by reference numeral 10, is shown in cross-section in FIG. 1A. The jarring apparatus 10 is sized and arranged to be deployed into a wellbore. Although not shown, the jarring apparatus may be deployed into a wellbore on wireline, tubing, such as coiled tubing, jointed pipe or the like.

The jarring apparatus 10 comprises a first jarring assembly in the form of a mandrel 12, and a second jarring assembly in the form of an outer housing assembly 14. The jarring apparatus 10 is configured such that relative rotation established between the mandrel 12 and outer housing assembly 14 causes repeated linear jarring forces to be generated. In use, the outer housing assembly 14 may be engaged with an object (not shown), such as a stuck object within a wellbore, with the mandrel 12 rotated via a suitable rotary drive, such as a motor, rotatable work string or the like, thus applying the generated jarring forces to the object.

In the present example the jarring apparatus 10 is arranged to provide axial jarring forces in the direction of arrow 16, which may be defined as an uphole direction. An axial pulling force may be applied to the mandrel in the direction of arrow 16 during the jarring operation. As will be described below in more detail, axial jarring in an opposite (e.g., downhole) direction, illustrated by arrow 17, may also be possible, with an optional axial pushing force applied to the mandrel in the direction of arrow 17.

Figure 1B:
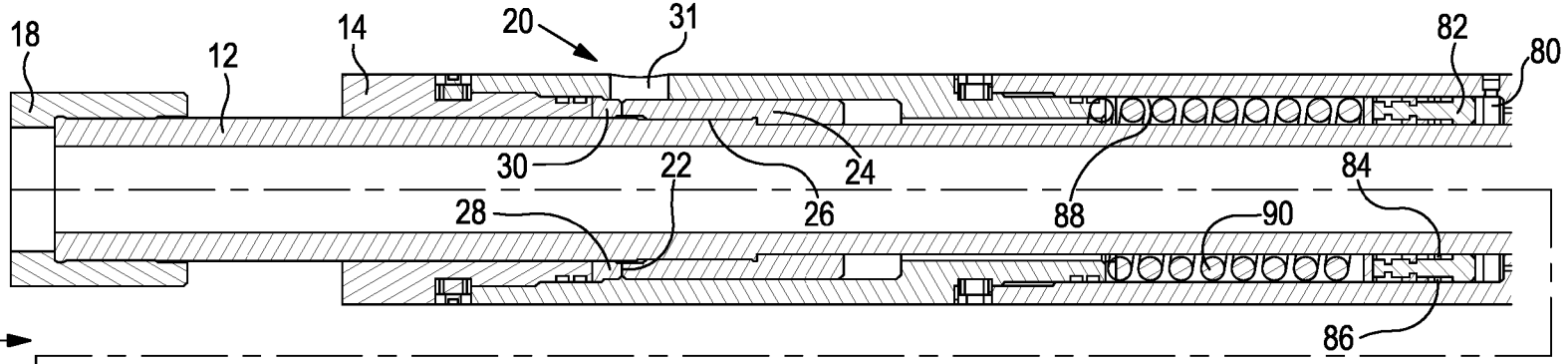
FIG. 1B is an enlarged, split view of the jarring apparatus of FIG. 1A.
Figure 1B:
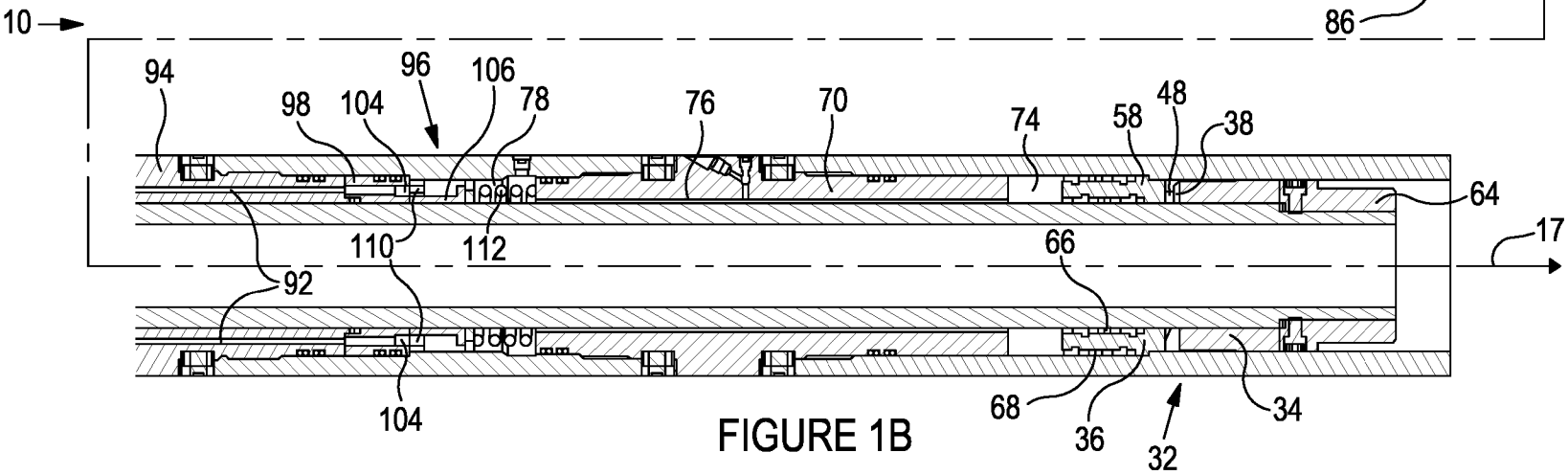

To aid the current description an enlarged split view of the jarring apparatus 10 of FIG. 1A is illustrated in FIG. 1B, reference to which is now made.

The mandrel 12 includes a tubular structure which extends into the outer housing assembly 14. A first or upper end of the mandrel 12 includes a suitable connector 18 for facilitating connection with a suitable deployment or drive structure, such as a work string.

An impact mechanism 20 is positioned towards the upper end of the apparatus 10. The impact mechanism 20 includes a first axial impact surface 22 provided on a hammer 24 which is fixed to the mandrel 12 via a threaded connection 26, and a second axial impact surface 28 provided on an anvil 30 fixed to the housing 14. The impact mechanism 20 is open to a space externally of the housing 14 via a port 31. In use, the port 31 may permit the impact mechanism 20, particularly the first and second impact surfaces 22, 28, to be exposed to wellbore fluid which functions to cool and/or lubricate the impact mechanism 20. In other examples, the impact mechanism 20 may alternatively be open to fluid within the mandrel 12, which may provide a cleaner environment. In further examples, the impact mechanism may be provided within a flow path.

A lifting mechanism 32 is positioned at a lower end of the apparatus 10, radially interposed between the mandrel 12 and the housing 14. The lifting mechanism 32 includes a first lifting structure in the form of a fixed cam 34, and a second lifting structure in the form of a shuttle cam 36. As will be described in more detail below, relative rotation between the fixed and shuttle cams 34, 36 permits relative axial movement, and corresponding potential energy, to be generated between the mandrel 12 and the housing 14, with corresponding axial separation provided between the first and second impact surfaces 22, 28 of the impact mechanism 20. Such axial separation may prepare the impact surfaces 22, 28 for subsequent axial impact together, as will be described in more detail below.

Figure 3:
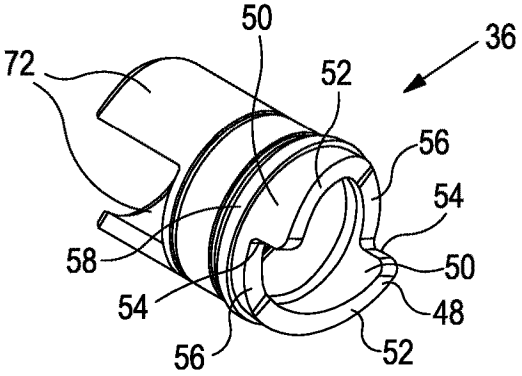
FIG. 3 illustrates a shuttle cam of a lifting mechanism of the jarring apparatus of FIG. 1A.
Figure 2:
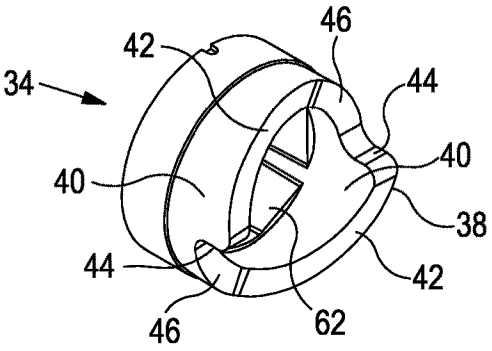
FIG. 2 illustrates a fixed cam of a lifting mechanism of the jarring apparatus of FIG. 1A.

Reference is additionally made to FIG. 2 which is a perspective view of the fixed cam 34, and FIG. 3 which is a perspective view of the shuttle cam 34. The fixed cam 34 includes a first rotary cam profile 38 which in the present example includes two circumferentially distributed cam lobes 40 each having a gradual ramp or rising portion 42, and a drop-off or falling portion 44, with a base portion 46 circumferentially positioned between each cam lobe 40. The shuttle cam 36 includes a complimentary second rotary cam profile 48, and thus includes two circumferentially distributed cam lobes 50 each having a gradual ramp or rising portion 52, and a drop-off or falling portion 54, with a base portion 56 circumferentially positioned between each cam lobe 50, 52.

Figure 4D:
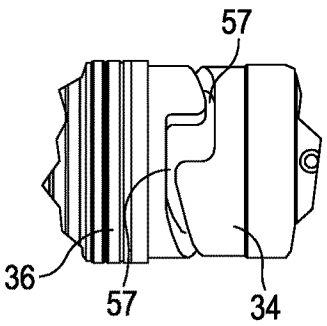
FIGS. 4A to 4D illustrates a rotary sequence of cooperation between the fixed and shuttle cams of the lifting mechanism.
Figure 4C:
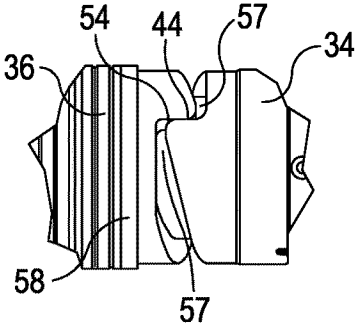
Figure 4B:
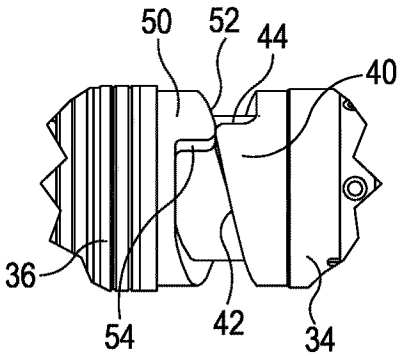
Figure 4A:
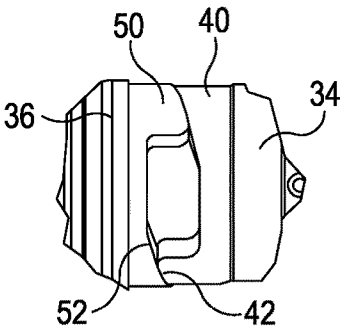

The complementary rotary cam profiles 38, 48 interengage and cooperate upon relative rotation therebetween to cyclically cause the cams 34, 36 to be displaced in one axial direction in a lifting phase, and to be displaced in a reverse axial direction in a dropping phase, as illustrated in FIGS. 4A to 4D. In this respect, FIG. 4A illustrates initial engagement of the respective ramp portions 42, 52 at the start of a lifting phase, with relative rotation therebetween permitting the cooperating ramp portions 42, 52 to circumferentially slide relative to each other and axially drive the cams 34, 36 apart towards a peak separation, as shown in FIG. 4B. As the cams 34, 36 progress towards the illustrated peak position in FIG. 4B the area of contact therebetween reduces, thus causing the stresses induced in the cams 34, 36 to increase. As will be described herein, the jarring apparatus 10 provides measures to minimise such stresses within the cams 34, 36, thus prolonging their operational life span.

Following completion of this lifting phase the drop-off portions 44, 54 become aligned, allowing the cams 34, 36 to "drop" and cause reverse axial displacement in a dropping phase, as illustrated in FIG. 4C. The cams 34, 36 are arranged within the jarring apparatus 10 such that at this dropping phase the first and second cam profiles 38, 48 are prevented from axial engagement or impact therebetween. That is, immediately following the dropping phase an axial separation gap 57 is provided between the first and second cam profiles 38, 48. This is achieved, at least in part, in the present example by the provision of a no-go profile in the form of an annular lip 58 provided on the shuttle cam 36 which engages a corresponding axial shoulder 60 on the housing 14 (see FIG. 1B). Furthermore, engagement between the impact surfaces 22, 28 also prevents travel of the fixed cam 34, maintaining separation between the cams 34, 36.

Following this dropping phase the cam lobes 40, 50 become aligned with the opposing base portions 46, 56, as illustrated in FIG. 4D, without contact therebetween, as noted above (i.e., the axial separation gap 57 is maintained). Further relative rotation may provide a transition from the completed dropping phase to initiation of a subsequent lifting phase, with the cycle of FIGS. 4A to 4D being repeated, causing cyclically lifting and dropping of the cams 34, 36. In the present examples, with each cam 34, 36 comprising two cam lobes 40, 50, the cams 34, 36 will undergo two cycles of lifting and dropping for each full 360 degrees of relative rotation therebetween. The provision of more or less cam lobes 40, 50 on each cam 34, 36 may facilitate more or less cycles for each full 360 degrees of relative rotation.

The fixed cam 34 is positioned radially between the mandrel 12 and the housing 14 and is rotatably fixed relative to the mandrel 12 via corresponding non-round profiles, such as a hex-profile (see internal hex-profile 62 on the fixed cam 34 illustrated in FIG. 2). The fixed cam 34 is axially engaged against an end cap 64 which permits the fixed cam 34 to be axially fixed relative to the mandrel 12 in the direction of arrow 17.

The shuttle cam 36 is also positioned radially between the mandrel 12 and the housing 14, and is sealed relative to the mandrel 12 via inner seals 66, and sealed relative to the housing 14 via outer seals 68. The shuttle cam 36 is rotatably fixed relative to the housing 14, specifically to a shuttle cam key coupling portion 70 of the housing 14. Referring again additionally to FIG. 3, the shuttle cam 36 includes a pair of diametrically opposed axially extending tabs or keys 72 which engage corresponding axial slots or keyways (not shown in FIG. 1B) formed in the shuttle cam key coupling portion 70 of the housing 14. Such a connection provides a rotary connection between the shuttle cam 36 and the housing, while still permitting relative axial movement therebetween.

The shuttle cam 36 is configured to be selectively axially fixed and released relative to the housing 14 via a hydraulic locking system, which will be described below. In the present example the hydraulic locking system functions to fix the shuttle cam 36 relative to the housing 14 during the lifting phase between the fixed and shuttle cams 34, 36, which thus permits the cooperation of the cams 34, 36 to cause corresponding relative axial movement of the mandrel 12 and housing 14, to axially separate the first and second impact surface 22, 28 and develop potential energy between the mandrel and housing. The hydraulic locking system functions to release the shuttle cam 36 relative to the housing 14 prior to completion of the lifting phase between the cams 34, 36, with such axial release permitting the generated potential energy to rapidly drive the impact surfaces 22, 28 together, to generate a jarring force. Accordingly, the jarring event is not initiated or caused by the dropping phase between the cams 34, 36, thus avoiding or minimising potential problems in the art.

The hydraulic locking system may be provided in numerous forms, to provide the function of cyclically hydraulically locking and releasing the shuttle cam 36 in accordance with operational requirements. Different examples will be described herein.

In the present example, the hydraulic locking system includes a first hydraulic chamber 74 which is defined between the mandrel 12, housing 14 and the shuttle cam 36. In the present example the first annular chamber includes a space immediately behind the shuttle cam, an annular gap 76 defined between the shuttle cam key coupling portion 70 and the mandrel 12, and a valve chamber 78. In the present example the hydraulic locking system further includes a second hydraulic chamber 80 defined between the mandrel 12, housing 14 and a floating piston 82, wherein the floating piston 82 is sealed relative to the mandrel 12 and housing 14 via inner and outer seals 84, 86. The floating piston 82 is axially moveable in a radial space 88 and is spring biased by spring 90 in a direction to reduce the volume of the second hydraulic chamber 80. In the present example the second hydraulic chamber includes the space immediately behind the floating piston 82 and gun drilled holes 92 through a floating piston body portion 94 of the housing 14. A volume of an incompressible hydraulic fluid, such as hydraulic oil is contained within the first and second hydraulic chambers 74, 80. In some examples, the hydraulic fluid may be pre-pressurised. This may allow or accommodate for any fluid compression, and gas compression and small leakage.

Although not illustrated, a pressure relief arrangement (e.g., a pressure relief valve) may be provided within the hydraulic locking system to prevent or minimise risk of overpressure causing damage.

A valve assembly 96 is interposed between the mandrel 12 and housing 14, and also between the first and second hydraulic chambers 74, 80, and is configurable between open and closed positions by relative rotation between the mandrel 12 and housing 14. When the valve assembly 96 is in its closed position fluid communication between the first and second hydraulic chambers 74, 80 is prevented, thus hydraulically locking the hydraulic fluid in the first hydraulic chamber 74, effectively axially fixing the shuttle cam 36 relative to the housing 14.

When the valve assembly 96 is in its open position fluid communication between the first and second hydraulic chambers 74, 80 is permitted, allowing fluid to be displaced from the first hydraulic chamber 74 to the second hydraulic chamber 80, with such fluid displacement accommodated by an increase in the volume of the second hydraulic chamber 80 by virtue of movement of the floating piston 82. Such displacement of fluid from the first hydraulic chamber 74 may effectively axially release the shuttle cam 36 from the housing 14.

The floating piston 82 may also function to accommodate thermal expansion/contraction of the fluid within the hydraulic locking system.

In the present example the shuttle cam 36 and the floating piston 82 are pressure balanced by virtue of equivalent sealed areas and by exposure to a common pressure (e.g., pressure within the mandrel 12 or externally of the housing 14.

Reference is additionally made to FIG. 5A which illustrates the valve assembly 96 and the floating piston body portion 94 of the housing 14, removed from the apparatus 10, and also to FIG. 5B which is an exploded view of the valve assembly 96 and the floating piston body portion 94.

The valve assembly 96 in the present example is provided in the form of a rotary gate valve assembly and comprises a gate valve nose 98 which is rotatably fixed to the floating piston body portion 94, and thus to the housing 14, via a pair of diametrically opposed key tabs 100 received in complimentary slots 102 in the floating piston body portion 94. In an alternative example the valve nose 98 may be integrally formed with the floating piston body 94/housing 14. The valve nose 98 includes two circumferentially arranged (in this case diametrically opposed) ports 104 extending axially therethrough and aligned with the gun drilled bores 92 in the floating piston body portion 94.

The valve assembly further comprises a gate valve selector 106 which is rotatably fixed relative to the mandrel via keys (not shown) which extend through key slots 108 in the valve selector 106. The valve selector 106 includes two circumferentially arranged ports 110 which are arranged at the same circumferential spacing as the corresponding ports 104 in the valve nose 98 (i.e., also diametrically opposed).

The valve selector 106 is axially engaged against the valve nose 98, with a gate spring 112 (see FIG. 1B) applying a biasing force therebetween. Relative rotation between the mandrel 12 and housing 14 causes corresponding relative rotation and sliding engagement between the valve nose 98 and the valve selector 106, thus cyclically aligning and misaligning the ports 104, 110, thus providing corresponding opening and closing of the valve assembly 96.

Such relative rotation between the valve selector 106 and valve nose 98 is diagrammatically illustrated in the sequence of FIGS. 6A to 6D. FIG. 6A illustrates the valve selector 106 and valve nose 98 being rotatably positioned such that the respective ports 110, 104 are misaligned and the valve assembly 96 thus being closed. FIG. 6B illustrates the valve selector 106 and valve nose 96 being rotatably advanced until the respective ports 110, 104 start to become aligned, and thus initiating reconfiguration of the valve assembly 96 to its open position. In this respect it will be noted that the leading (i.e., rotatably leading) portions of the ports 110, 104 define a tapering profile. This may provide a gradual increase in flow area as the ports begin to align, which may provide advantages such as minimising hydraulic shock as the valve assembly 96 begins to open. It should be understood that any port profile may be incorporated, in accordance with operational requirements. For examples, the ports may be formed to ensure a large flow area is rapidly developed during initial valve opening.

Further relative rotation between the valve selector and nose 106, 98 allows the ports 110, 104 to become fully aligned, as shown in FIG. 6C, and subsequently to begin to become misaligned again, as shown in FIG. 6D.

Accordingly, by appropriate timing between the lifting and dropping phases of the fixed and shuttle cams 34, 36 within the lifting mechanism 32, and of the opening and closing of the valve assembly 96, suitable operation of the jarring apparatus 10 may be achieved. In this respect, such timing may be readily facilitated by virtue of both the lifting mechanism 32 and valve assembly 96 being commonly operated by relative rotation between the mandrel 12 and housing 14.

A full cycle of operation of the apparatus 10 will now be described with reference to FIGS. 7A to 12C.

Figures 7A, 7B, 7C, 8A, 8B, 8C:
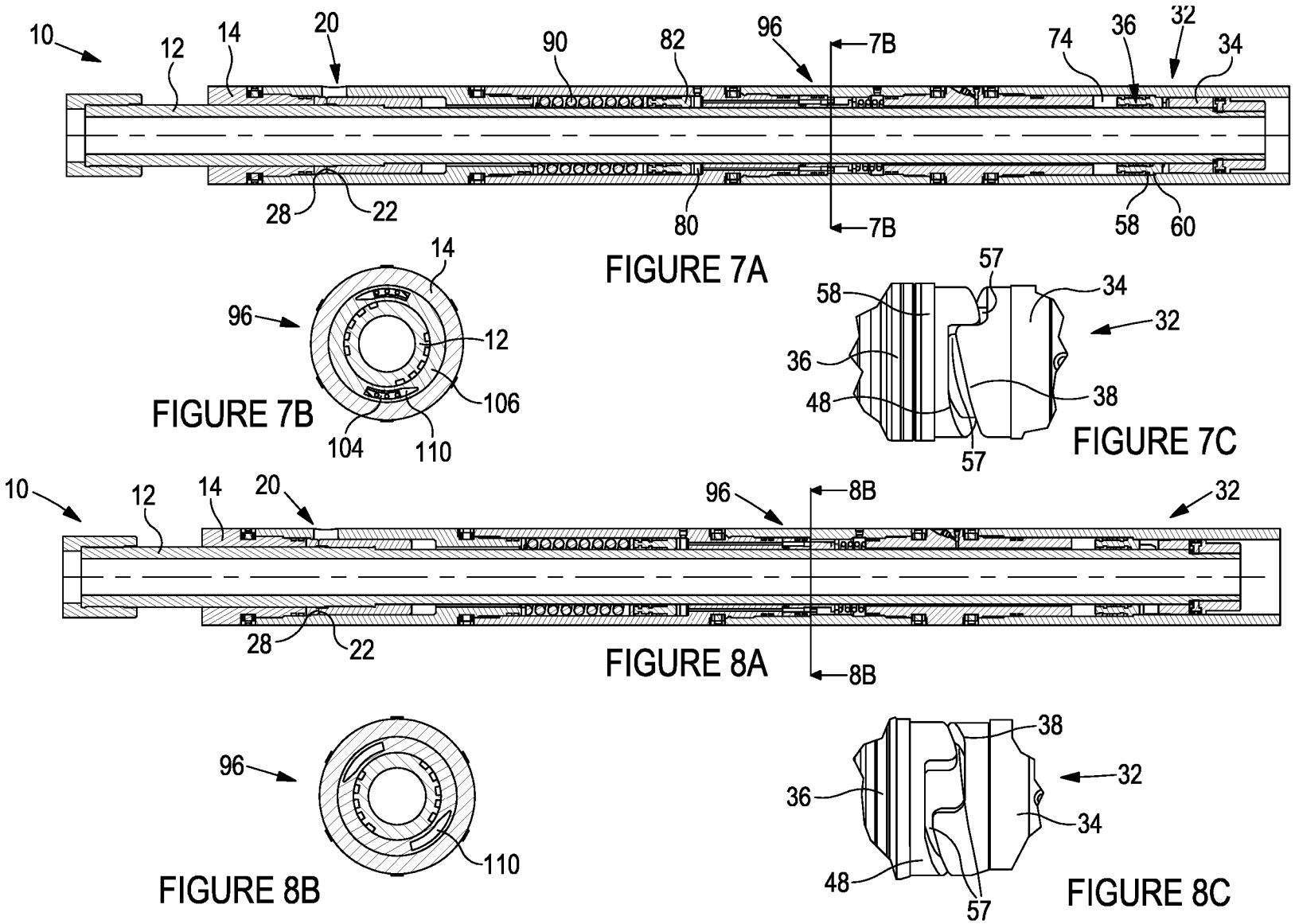

Reference is initially made to FIGS. 7A to 7C, wherein the apparatus 10 is illustrated in an initial configuration in FIG. 7A, the corresponding configuration of the valve assembly 96 is illustrated in FIG. 7B, which is a cross-section taken through line 7B-7B of FIG. 7A, and the corresponding configuration of the lifting mechanism 32 is illustrated in FIG. 7C. When in this initial position the housing 14 may be engaged with an object (not shown), such as an object stuck in a wellbore, which effectively causes the housing 14 to become fixed. The mandrel 12 is coupled to a drive structure, such as a work string (not shown), and is thus operated to rotate relative to the housing 14. An axial pulling force may be applied to the mandrel 12, for example via a work string, to apply axial preloading between the mandrel and housing 14.

When in this initial configuration the impact surfaces 22, 28 of the impact mechanism 20 are engaged such that any initial pulling force applied to the mandrel 12 generates loading between said impact surfaces 22, 28, and thus between the mandrel 12 and the housing 14. The ports 104, 110 of the valve assembly 96 are aligned such that the valve 96 is in an open configuration and the shuttle cam 36 is thus axially released from the housing 14. Although the shuttle cam 36 may be considered to be axially released from the housing 14 when the valve assembly 96 is open, the shuttle cam 36 is nevertheless biased axially towards the fixed cam 34 by virtue of the spring 90 acting on floating piston 82, which in turn acts on the hydraulic fluid contained within the first and second hydraulic chamber 74, 80. When in this initial configuration the annular lip 58 of the shuttle cam 36 is engaged with the axial shoulder 60 of the housing 14.

As illustrated in FIG. 7C, the first and second cam profiles 38, 48 of the fixed and shuttle cams 34, 36 respectively are not engaged (separation gap 57).

Rotation of the mandrel 12 relative to the housing 14 eventually causes the valve assembly 96 to close by misalignment of the ports 104, 110, as illustrated in FIGS. 8A and 8B, wherein FIG. 8B is a sectional view taken through line 8B-8B of FIG. 8A. The shuttle cam 36 thus becomes hydraulically locked relative to the housing 14. When in this configuration the fixed cam 34 has rotatably progressed, but the first and second cam profiles 38, 48 remain separated and non-engaged (separation gap 57). As an example, the mandrel may have been rotated by around 40 degrees relative to the initial position of FIG. 7A to reach this stage in which the valve assembly 96 becomes closed.

Figure 9A:
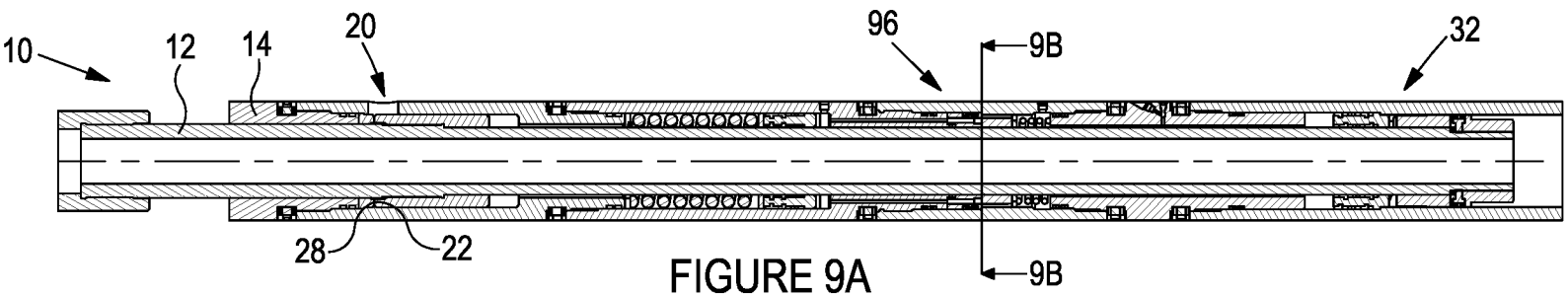
Figure 9B:
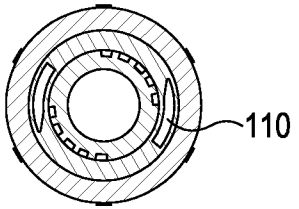
Figure 9C:
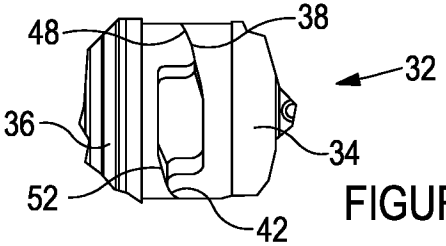

Continued rotation of the mandrel 12, illustrated in FIG. 9A, maintains the valve assembly 96 in its closed configuration, as illustrated in FIG. 9B, which is a sectional view taken through line 9B-9B of FIG. 9A, and eventually brings the cam profiles 38, 48 into engagement, as illustrated in FIG. 9C. Specifically, opposing ramp portions 42, 52 become engaged in preparation to initiate the lifting phase. When in the configuration illustrated in FIG. 9A, the impact surfaces 22, 28 of the impact mechanism remain engaged. As an example, the mandrel may have been rotated by around 77 degrees relative to the initial position of FIG. 7A to reach this stage.

Figure 10A:
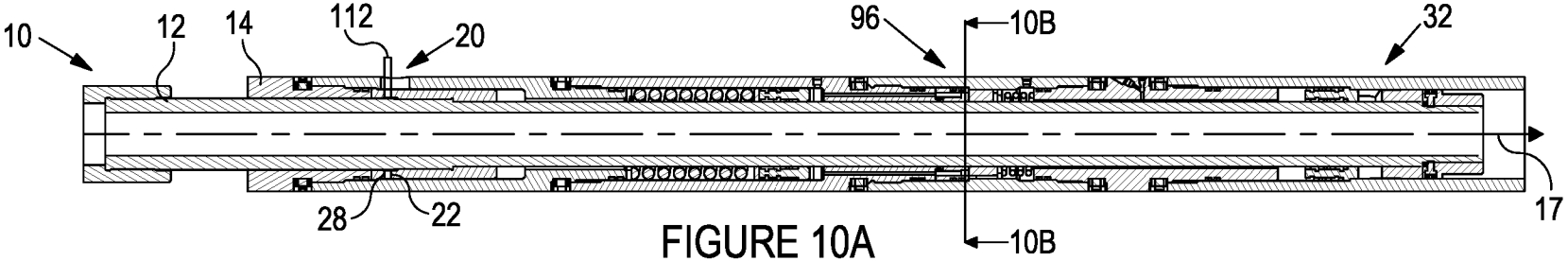
Figure 10B:
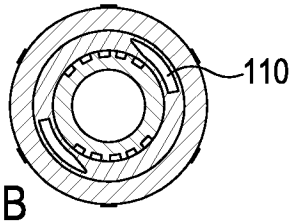
Figure 10C:
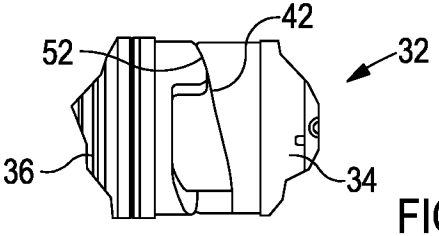

Further rotation of the mandrel 12, illustrated in FIG. 10A, maintains the valve assembly 96 in its closed configuration, as illustrated in FIG. 10B, which is a sectional view taken through line 10B-10B, and causes the ramp portions 42, 52 of the fixed and shuttle cams 34, 36 to slide over each other and cause relative axial displacement of the cams 34, 36 to provide the lifting phase, as illustrated in FIG. 10C. By virtue of the shuttle cam 36 being hydraulically locked and axially fixed to the housing 14 the axial separation between the cams 34, 36 causes the mandrel 12 to be moved axially in the direction of arrow 17, causing the first and second impact surfaces 22, 28 to become axially separated by distance 112. Such axial movement of the mandrel 12 generates potential energy between the mandrel 12 and housing 14. As an example, the mandrel may have been rotated by 128 degrees relative to the initial position of FIG. 7A to reach this stage.

Figure 11A:
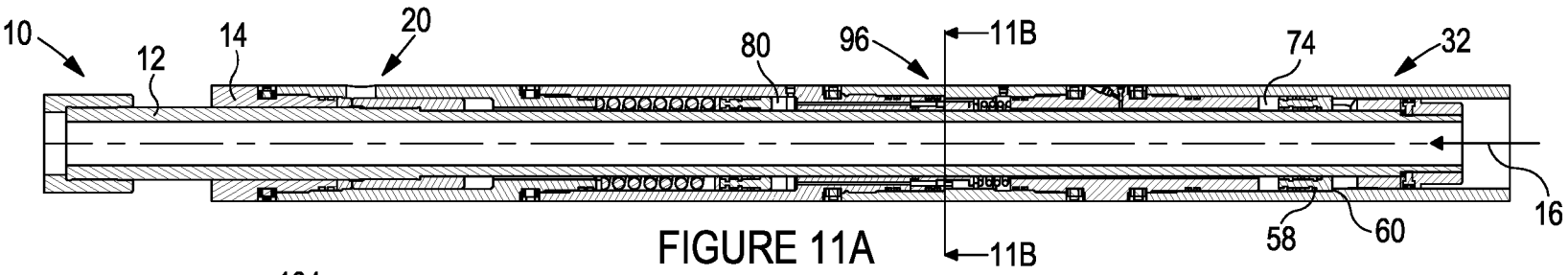
Figure 11B:
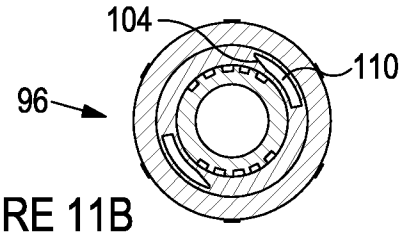

Further rotation of the mandrel 12, illustrated in FIG. 11A, causes the ports 104, 110 of the valve assembly 96 to start to become aligned, as illustrated in FIG. 10B, which is a sectional view taken through line 11B-11B, thus reconfiguring the valve assembly 96 into its open configuration. This establishes communication between the first and second hydraulic chambers 74, 80 and axially releases the shuttle cam 36 from the housing 14. This axial release of the shuttle cam 36 permits the loading and potential energy generated between the mandrel 12 and housing 14 to be rapidly relieved, causing mandrel 12 to axially move in the direction of arrow 16 and the first and second impact surfaces 22, 28 to be rapidly impacted together, generating a jarring force. As illustrated in FIG. 11A, as the shuttle cam 36 is axially released from the housing 14 the movement of the mandrel 12 in the direction of arrow 16 causes the shuttle cam 36 to also move axially in the direction of arrow 16, axially separating the annular lip 58 of the shuttle cam 36 from the axial shoulder 60 of the housing 14. As an example, the mandrel may have been rotated by 129 degrees relative to the initial position of FIG. 7A to reach this stage of generating a jarring force within the apparatus 10.

Figure 11C:
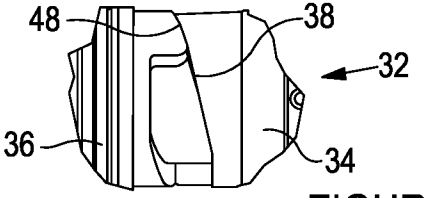

As illustrated in FIG. 11C, the ramp profiles 38, 48 of the fixed and shuttle cams 34, 36 remain engaged. However, the axial release of the shuttle cam 36 from the housing 14 relieves or reduces, for example significantly reduces, loading applied between the fixed and shuttle cams 34, 36, thus minimising stress therein. The timing of axial release of the shuttle cam 36 may be selected to be such that a relatively large surface area of contact between the ramp profiles 38, 48 exists during the initial lifting and loading phase, again assisting to control levels of stresses applied in the cams 34, 36.

Figure 12A:
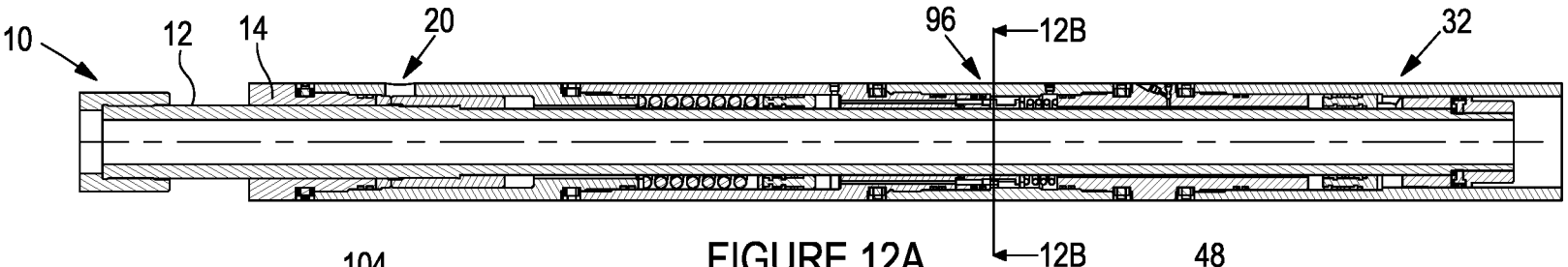
Figure 12B:
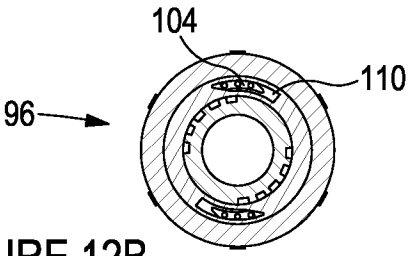
Figure 12C:
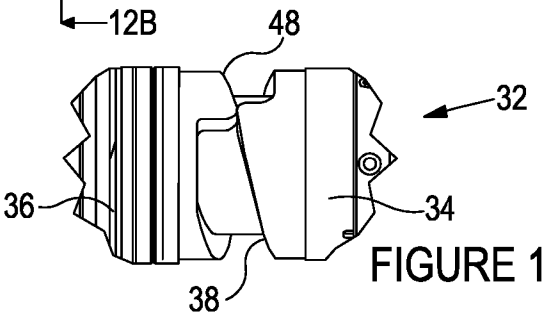

The configuration of the apparatus 10 upon further rotation of the mandrel 12 is illustrated in FIG. 12A. As shown in FIG. 12B, which is a sectional view taken through lines 12B-12B in FIG. 12A, the valve assembly 96 remains opened, with the ports 104, 110 still aligned during this further rotation. The further rotation also causes the fixed cam 34 to further rotate relative to the shuttle cam 36, causing the ramp profiles 38, 48 to reach the peak position, as illustrated in FIG. 12C, reflecting the maximum axial separation between the cams 34, 36. As the valve assembly 96 remains open during this phase of rotation loading applied between the reducing contact area between the ramp profiles 38, 48 is minimised, thus minimising stresses within the cams 34, 36. As an example, the mandrel may have been rotated by 168 degrees relative to the initial position of FIG. 7A to reach this stage of the cams 34, 36 peaking.

Further rotation of the mandrel 12, for example now 180 degrees relative to the initial position of FIG. 7A, will cause the cams 34, 36 to effectively drop (i.e., the shuttle cam 36 "drops" relative to the fixed cam 34), returning the apparatus 10 to the initial configuration of FIG. 7A. Continuous rotation of the mandrel 12 will cause continuous cycles of jarring, as described above. In this respect the jarring frequency will be a function of the number of cam profiles 40, 50 provides on the cams 34, 36, and the rotational speed of the mandrel 12. The jarring frequency may also be influenced by the number of ports provided in the valve assembly 96. In use, the jarring frequency may be readily adjusted by adjusting the rotational speed of the mandrel 12.

Furthermore, the force applied for each impact event may be dictated by the level of initial preloading applied (e.g., magnitude of pulling force on the mandrel 12) and the axial displacement of the mandrel 12 relative to housing 14 prior to impact. Accordingly, a user may readily adjust the desired jarring force generated within the apparatus 10.

Figure 13:
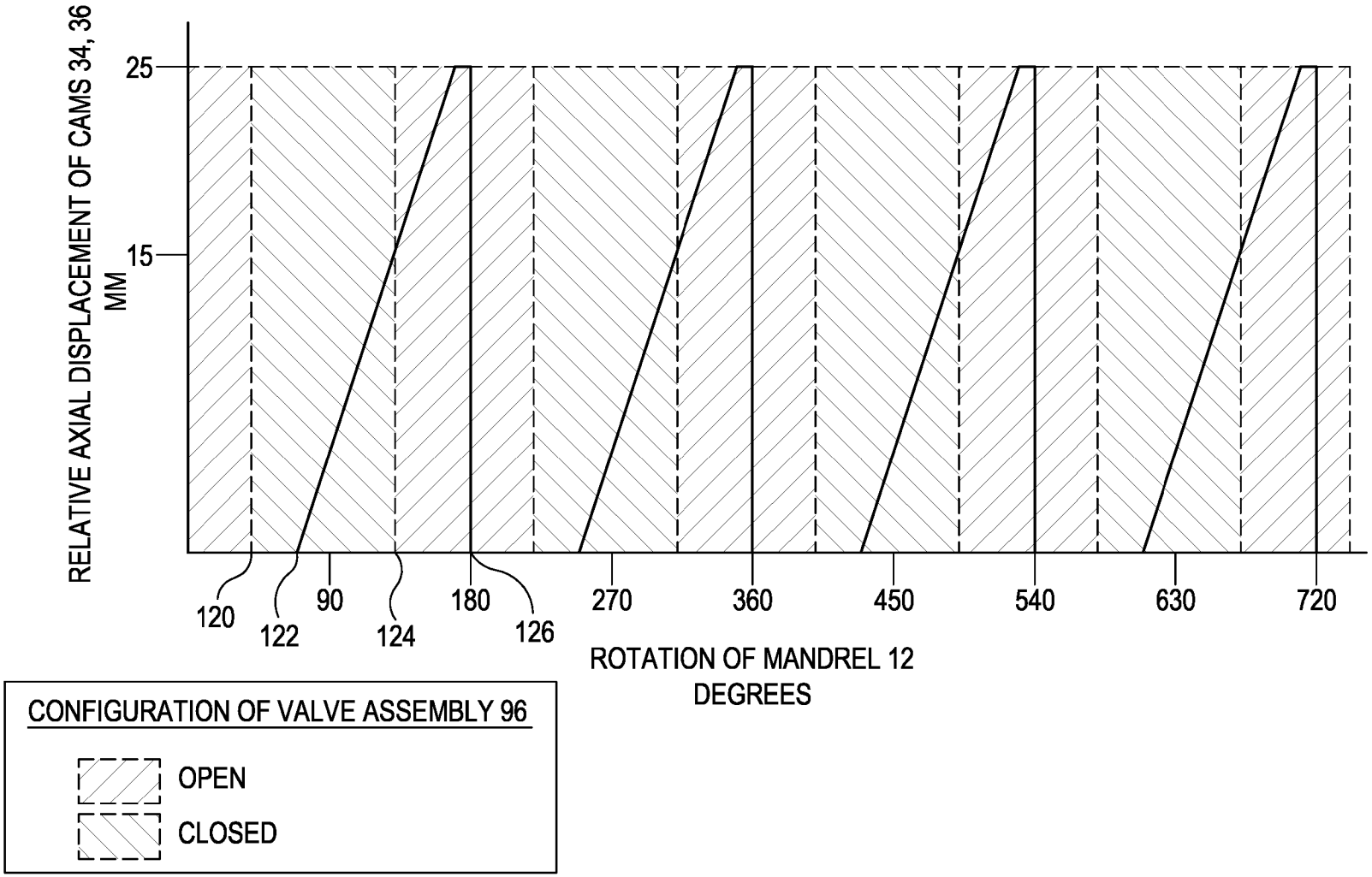
FIG. 13 graphically illustrates the relative rotational progression and axial displacement between the shuttle and fixed cams of the lifting mechanism, and corresponding timing of the axial release of the shuttle cam.

The operational cycle of the apparatus 10 may be represented graphically in FIG. 13. This graph illustrates the axial displacement of the cams 34, 36 during rotation of the mandrel 12, and is overlaid with the associated cyclical reconfiguration of the valve assembly 96 between its open and closed configurations. While example rotational and axial displacements are presented in FIG. 13 and the description below, these are provided only for exemplary purposes and are in no way limiting.

The following sequence is illustrated:

1. The origin O of the graph reflects the configuration of the apparatus as shown in FIGS. 7A to 7C, wherein the valve assembly 96 is open and there is zero displacement between the cams 34, 36;

2. The mandrel reaches 40 degrees of rotation, illustrated by point 120, causing the valve assembly 96 to close, with still zero displacement between the cams 34, 36, reflecting the configuration of the apparatus 10 in FIGS. 8A to 8C;

3. The mandrel reaches 77 degrees of rotation, illustrated by point 122, at which the cams 34, 36 initiate their lifting phase, reflecting the configuration of the apparatus 10 in FIGS. 9A to 9C;

4. The mandrel reaches 129 degrees of rotation, illustrated by point 124, at which the valve assembly 96 is opened allowing jarring impact to be achieved, reflecting the configuration of the apparatus in FIGS. 11A to 11C. In the present example the axial displacement of the cams 34, 36, and of the first and second impact surfaces 22, 28 of the impact mechanism (see, for example, FIG. 1B) may be in the region of 15 mm;

5. The mandrel reaches approximately 168 to 180 degrees of rotation, illustrated by point 126, at which the cams 34, 36 peak and then drop or reset in their dropping phase. In the present example the peak axial displacement between the cams 34, 36 may be in the region of 25 mm.

The cycle above is repeated during continuous rotation of the mandrel 13, as illustrated in FIG. 13.

The timing of the lifting and dropping phases of the cams 34, 36 and the opening and closing of the valve apparatus 96 may be readily adjusted to achieve the desired operation of the apparatus 10. For example, delaying the opening of the valve assembly 96 may permit a greater separation between impact surfaces 22, 28 to be achieved, and thus more energy to be generated between the mandrel 12 and housing.

The common operation of the valve assembly 96 and the lifting mechanism 32 by the relative rotation between the mandrel 12 and the housing 14 may facilitate the appropriate timing of operation to be readily achieved and adjusted, for example by simple relative alignment of the different components on the mandrel 12 and/or housing 14.

In FIG. 13 the axial displacement of the cams 34, 36 is illustrated as being linear during rotation of the mandrel. However, this need not be the case, and a non-linear profile may be achieved in accordance with the profile selected for the ramp portions 38, 48 of the respective cams 34, 36 (see, for example, FIGS. 2 and 3).

Figure 14:
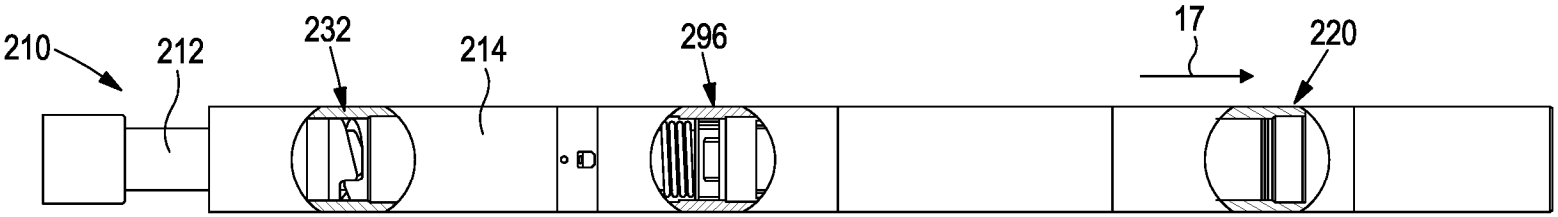
FIG. 14 is a part cut-way view of an alternative jarring apparatus, configured to generate a jarring force in a direction opposite to that provided by the jarring apparatus of FIG. 1A.

In the example provided above the apparatus 10 is configured to generate a jarring force in an uphole direction. In other examples, however, a jarring apparatus may be provided which permits jarring in a downhole direction. An example of such a jarring apparatus, which is generally identified by reference numeral 210, is illustrated in FIG. 14. For ease of reference, only selected sections of the apparatus 210 is shown in part cut-away.

The apparatus 210 is effectively configured in a similar manner to apparatus 10 and as such like features share like reference numerals, incremented by 200. In the present case the apparatus 210 also includes a mandrel 212, housing 214, an impact mechanism 220, lifting mechanism 232 and valve assembly 296, each configured similarly to their counterpart in the apparatus 10 described above. However, in the present case these features are, as illustrated, arranged in inverted order. All other operational principles as described above in relation to apparatus 10 also apply to the present illustrated apparatus 210. However, in the present case an axial pushing force in the direction of arrow 17 may optionally be applied on the mandrel 212 to provide preloading.

In some examples a simple inversion of the lifting mechanism may require an opposite rotation of the mandrel. In some cases this may be acceptable. However, in other cases such opposite rotation may not be desired, for example where there might be a risk of causing threaded connections in the apparatus or connected infrastructure from being backed-off. In such cases it may be desirable to "reverse" the cam structures to maintain a desired relative rotation direction.

In some examples a jarring apparatus may be provided which includes two separate and inverted jarring assemblies, such that the same jarring apparatus may be capable of providing jarring in opposite directions.

Figure 15A:
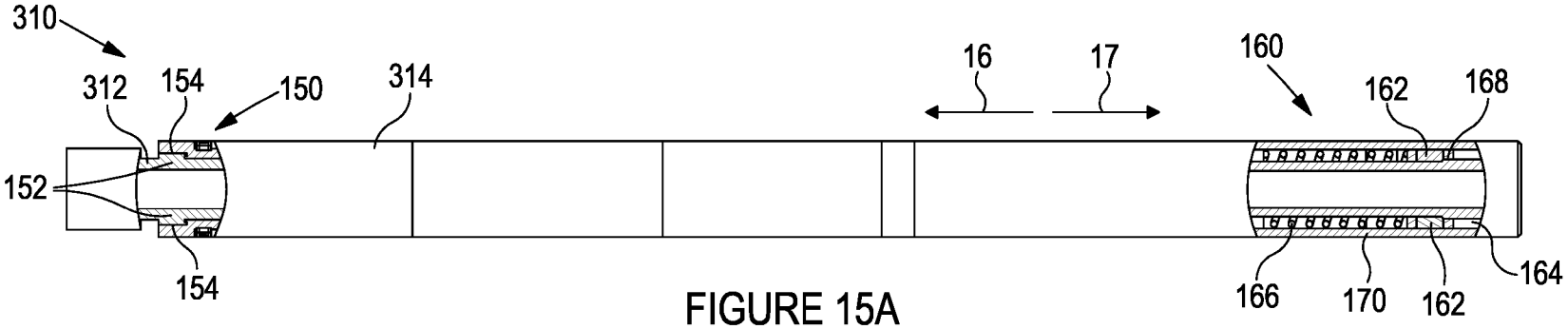
FIGS. 15A and 15B diagrammatically illustrate, in part cut-away and sectional view, a jarring apparatus capable of being configured between non-jarring and jarring configurations.
Figure 15B:
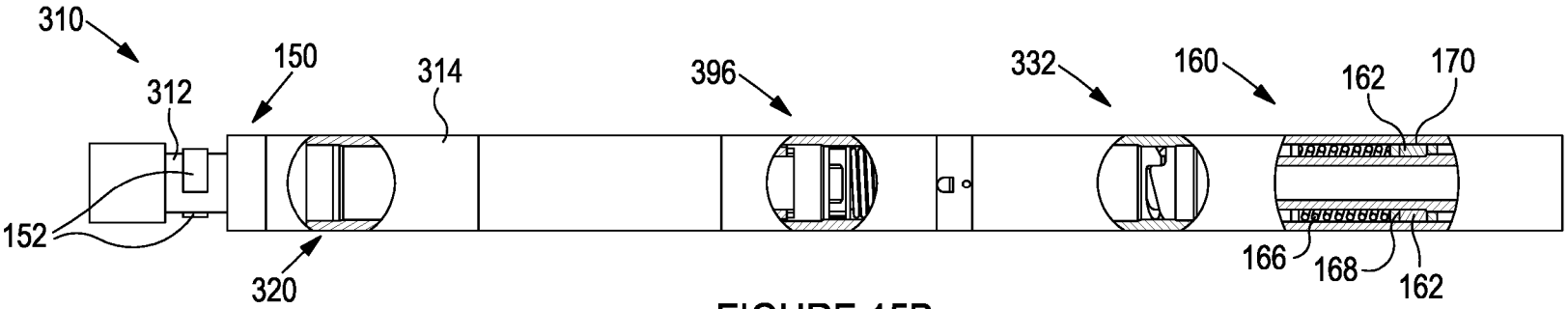

In the examples provided above the jarring apparatus may be provided in a single jarring mode of operation, in which the mandrel and housing are rotatable relative to each other to cause cyclical jarring events, as described above. However, in other examples a jarring apparatus may be provided which is reconfigurable between a jarring mode of operation and a non-jarring mode of operation. Such a jarring apparatus, generally identified by reference numeral 310, will now be described with reference to FIGS. 15A and 15B, wherein FIG. 15A illustrates the apparatus 310 when configured in a non-jarring configuration, and FIG. 15B illustrates the apparatus 310 when configured in a jarring configuration. Both FIGS. 15A and 15B include part cutaway sections to illustrate internal detail. The jarring apparatus 310 is similar in many respects to apparatus 10 described above, and as such like features share like reference numerals, incremented by 300. In particular, the jarring apparatus 310 is structured in the same way as in apparatus 10 to provide axial jarring forces in response to a rotary drive.

The apparatus 310 includes a mandrel 312 and a housing 314, and a rotatable locking mechanism 150 interposed between the mandrel 312 and housing 314. The rotatable locking mechanism includes a number of keys 152 mounted on the mandrel 312 and a number of corresponding keyways 154 provided in the housing 314. When the apparatus 310 is configured in its non-jarring configuration as shown in FIG. 15A, the mandrel 312 and housing 314 are axially positioned relative to each other such that the keys 152 are received in the keyways 154, thus rotatably locking the mandrel 312 and housing 314 together. Accordingly, relative rotation between the mandrel 312 and housing 314 may not be permitted, and as such any jarring which would otherwise be generated by such relative rotational movement may be prevented.

By rotatably locking the mandrel 312 and housing 314 together it will be possible to transmit torque therethrough. Such transmission of torque may permit the apparatus 310 to have application in, for example, drilling operations. In one example, the mandrel 312 may be coupled to a rotary drill string (not shown), and the housing 314 may be coupled to a drilling BHA (also not shown), wherein rotation of the drill string causes corresponding rotation of the BHA.

The apparatus 310 further comprises an axial locking (or release) system 160 interposed between the mandrel 312 and housing 314. The axial locking system 160 includes a circumferential array of keys or dogs 162 which are positioned within a radial gap 164 between the mandrel 312 and housing 314. The dogs 162 are axially biased, with reference to the housing 314, by a spring 166 in the direction of arrow 17. In the configuration of FIG. 15A the dogs 162 are axially engaged with an annular no-go profile 168 provided on the mandrel 312. Accordingly, applying a pulling force on the mandrel 312 in the direction of arrow 16 (and/or applying a pushing force on the housing 314 in the direction of arrow 17) will cause the mandrel 312 and housing 314 to move axially relative to each other, against the force applied by the spring 166. Release of any axial force will permit the spring 166 to return the mandrel 312 and housing 314 to their initial position.

In the event of jarring being required, for example due to sticking of a drill string, BHA or the like, the apparatus 310 may be reconfigured to a jarring configuration by applying a sufficiently large pulling force on the mandrel 312 (and/or pushing force on the housing 314) such that the dogs 162 become aligned with an annular recess 170 formed on an inner surface of the housing 314, allowing the dogs 162 to become released from the no-go profile 168 on the mandrel, as illustrated in FIG. 15B. This may disengage the locking or resistance effect of the dogs 162 and spring 166, such that sufficient axial movement between the mandrel 312 and housing 314 may be achieved to disengage the keys 152 from the keyways 154 of the rotatable locking mechanism 150, as shown in FIG. 15B. Such sufficient relative axial movement may permit appropriate operational alignment or reconfiguration of an impact mechanism 320, lifting mechanism 332 and valve assembly 96, which may function in a similar manner to that described above with reference to apparatus 10 to generate axial jarring in response to relative rotation between the mandrel 312 and housing 314.

Should it be desirable to reconfigure the apparatus 310 back to the non-jarring configuration then reverse relative axial movement between the mandrel 312 and housing 314 may be performed, to reset the axial locking system 160, and reengage the keys 152 with the keyways 154 of the rotatable locking mechanism 150.

In examples described above a hydraulic locking system is included for cyclically hydraulically locking and releasing the shuttle cam. Specifically, an example described above (apparatus 10) includes a valve assembly 96 incorporating axially arranged ports 104, 110, and operable to selectively isolate and communicate first and second hydraulic chambers. However, other examples may use a different form of valve assembly, for example one which includes radial ports. Further, the second hydraulic chamber may instead be provided by a flow path which extends through the jarring apparatus. Such alternative examples will now be described with reference to FIGS. 16A to 24C.

Figure 16A:
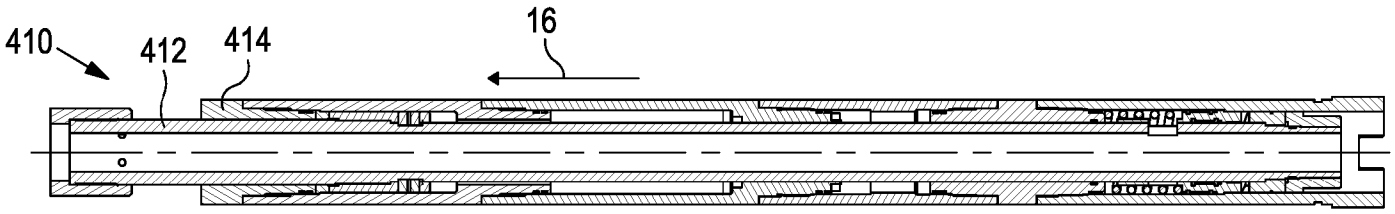
FIG. 16A is a longitudinal cross-sectional view of an alternative jarring apparatus.
Figure 16B:
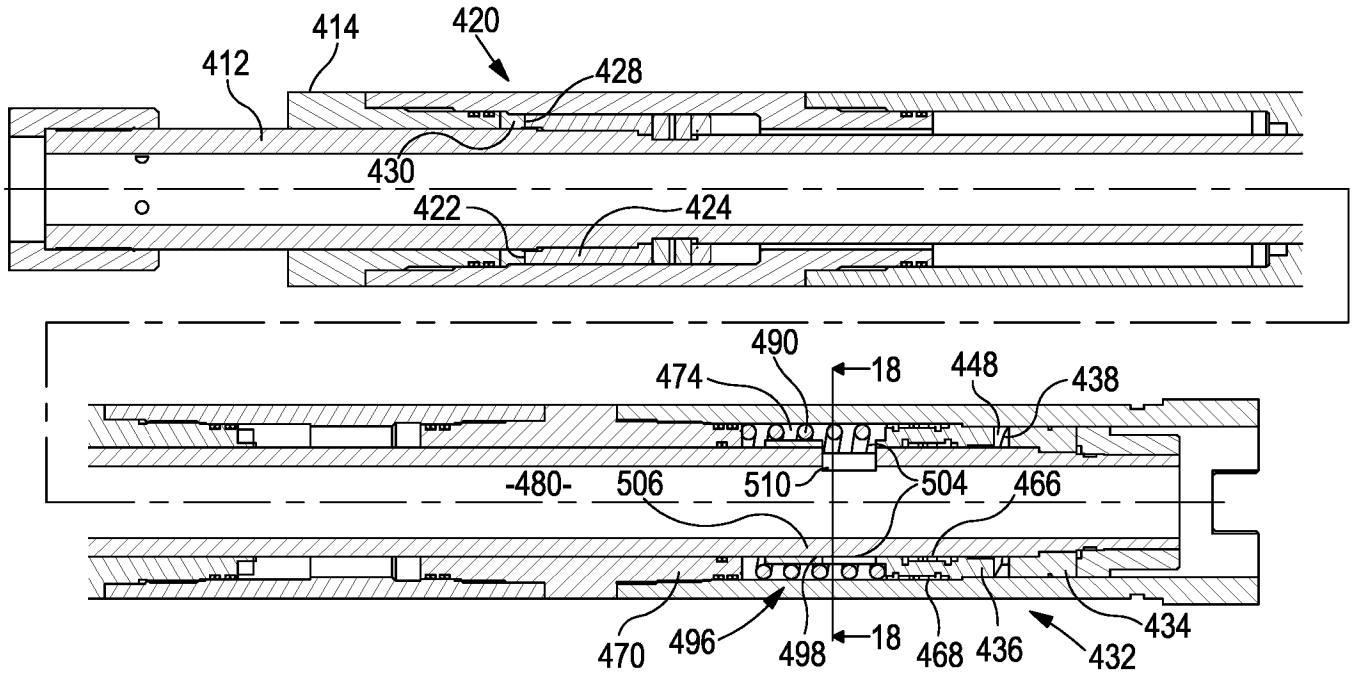
FIG. 16B is an enlarged, split view of the jarring apparatus of FIG. 16A.

A jarring apparatus, generally identified by reference numeral 410, is shown in cross-section in FIG. 16A. To aid the current description an enlarged split view of the jarring apparatus 410 of FIG. 16A is illustrated in FIG. 16B. The apparatus 410 is similar in many respects to the apparatus 10 first shown in FIG. 1A, and as such like features share like reference numerals, incremented by 400.

The jarring apparatus 410 comprises a first jarring assembly in the form of a mandrel 412 and a second jarring assembly in the form of an outer housing assembly 414. The apparatus 410 is configured such that relative rotation established between the mandrel 412 and outer housing assembly 414 causes repeated linear jarring forces to be generated in the direction of arrow 16.

An impact mechanism 420 is positioned towards the upper end of the apparatus 410 and includes a first axial impact surface 422 provided on a hammer 424 which is fixed to the mandrel 412, and a second axial impact surface 428 provided on an anvil 430 fixed to the housing 414.

A lifting mechanism 432 is positioned at a lower end of the apparatus 410, radially interposed between the mandrel 412 and the housing 414. The lifting mechanism 432 includes a first lifting structure in the form of a fixed cam 434, and a second lifting structure in the form of a shuttle cam 436. The fixed and shuttle cams 434, 436 are provided largely in the same form and function in the same manner as the corresponding cams 34, 36 in the apparatus 10 described above. As such, no further detailed description will be given, other than to note that each cam 434, 436 includes respective and complimentary rotary cam profiles 438, 448 which inter-engage and cooperate upon relative rotation therebetween to cyclically cause the cams 434, 436 to be displaced in one axial direction in a lifting phase, and to be displaced in a reverse axial direction in a dropping phase.

The fixed cam 434 is positioned radially between the mandrel 412 and the housing 414 and is rotatably fixed relative to the mandrel 412. The shuttle cam 436 is also positioned radially between the mandrel 412 and the housing 414, and is sealed relative to the mandrel 412 via inner seals 466, and sealed relative to the housing 414 via outer seals 468. The shuttle cam 436 is rotatably fixed relative to the housing 414, specifically to a shuttle cam key coupling portion 470 of the housing 414, which will be described in more detail below. A spring 490 biases the shuttle cam 436 towards the fixed cam 434.

The shuttle cam 436 is configured to be selectively axially fixed and released relative to the housing 414 via a hydraulic locking system. The hydraulic locking system functions to fix the shuttle cam 436 relative to the housing 414 during the lifting phase between the fixed and shuttle cams 434, 436, which thus permits the cooperation of the cams 434, 436 to cause corresponding relative axial movement of the mandrel 412 and housing 414, to axially separate the first and second impact surface 422, 428 and develop potential energy between the mandrel and housing. The hydraulic locking system functions to release the shuttle cam 436 relative to the housing 414 prior to completion of the lifting phase between the cams 434, 436, with such axial release permitting the generated potential energy to rapidly drive the impact surfaces 422, 428 together, to generate a jarring force.

In the present example, the hydraulic locking system includes a first hydraulic chamber 474 which is defined radially between the mandrel 412 and housing 414, and axially between the shuttle cam 436 and the shuttle cam key coupling portion 470. The hydraulic locking system further includes a second hydraulic chamber 480 defined by a flow path extending through the mandrel 412.

A valve assembly 496 is provided between the first and second hydraulic chambers 474, 480, and is configurable between open and closed positions by relative rotation between the mandrel 412 and housing 414. When the valve assembly 496 is in its closed position fluid communication between the first and second hydraulic chambers 474, 480 is prevented, thus hydraulically locking the hydraulic fluid in the first hydraulic chamber 474, effectively axially fixing the shuttle cam 436 relative to the housing 414. When the valve assembly 496 is in its open position fluid communication between the first and second hydraulic chambers 474, 480 is permitted, allowing fluid to be displaced from the first hydraulic chamber 474 to the second hydraulic chamber 480, and effectively axially release the shuttle cam 436 from the housing 414.

Figure 17:
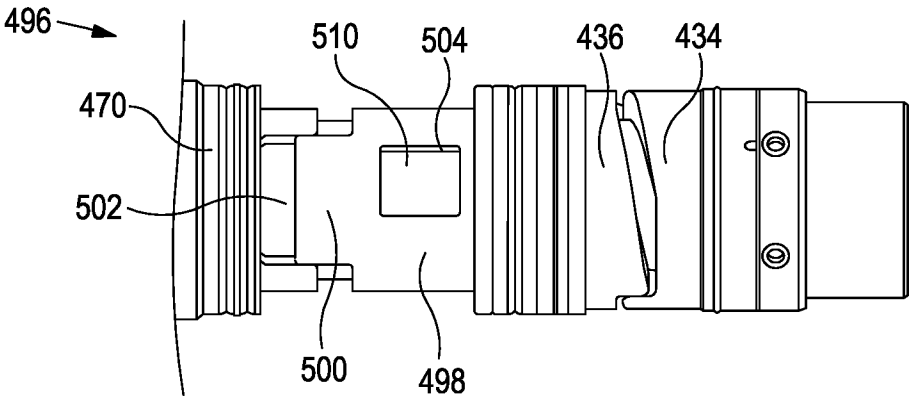
FIG. 17 is an elevational view of lifting structures and a valve assembly of the jarring apparatus of FIG. 16A.
Figure 18:
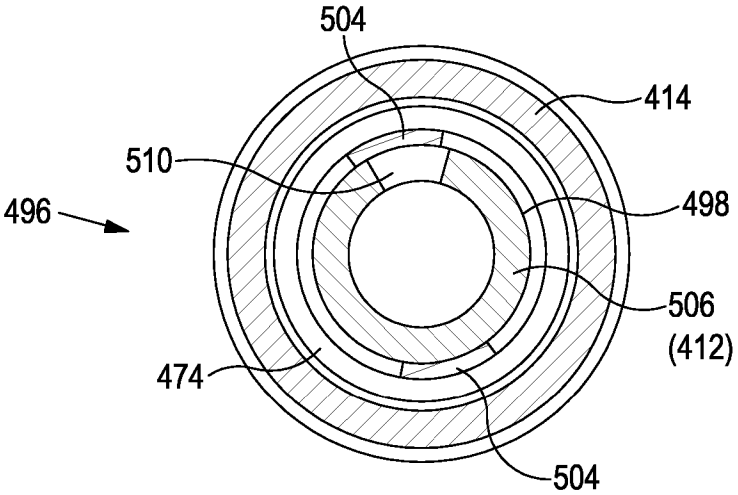
FIG. 18 is a cross sectional view taken along line 18-18 of FIG. 16B.

Reference is additionally made to FIG. 17 which illustrates the valve assembly 496 and cams 434, 436, and also to FIG. 18 which is sectional view along line 18-18 of FIG. 16B, with the spring 490 removed for clarity.

The valve assembly 496 in the present example is provided in the form of a rotary plug valve and comprises a valve sleeve 498 which is rotatably fixed to the shuttle cam key coupling portion 470, and thus to the housing 414, via a pair of diametrically opposed key tabs 500 (only one visible in FIG. 17) received in complimentary slots 502 in the shuttle cam key coupling portion 470. In this example the valve sleeve 498 is integrally formed with the shuttle cam 436, and thus provides a rotary connection between the housing 414 and the shuttle cam 436.

The valve sleeve 498 includes two circumferentially arranged (in this case diametrically opposed) ports 504 extending radially therethrough.

The valve assembly 496 further comprises a valve selector portion 506, which is formed by the mandrel 412, and includes a single port 510 extending radially through the valve selector portion 506 (two diametrically opposed ports could be provided in the selector portion 506).

The valve sleeve 498 and valve selector portion 506 are thus arranged for relative rotation therebetween in accordance with relative rotation between the mandrel 412 and the housing 414 to cause cyclical alignment and misalignment of the ports 504, 510 to effectively open and close the valve assembly 496.

By appropriate timing between the lifting and dropping phases of the fixed and shuttle cams 434, 436 within the lifting mechanism 432, and of the opening and closing of the valve assembly 496, suitable operation of the jarring apparatus 410 may be achieved. In this respect, such timing may be readily facilitated by virtue of both the lifting mechanism 432 and valve assembly 496 being commonly operated by relative rotation between the mandrel 412 and housing 414.

A full cycle of operation of the apparatus 410 will now be described with reference to FIGS. 19A to 24C.

Figure 19A:
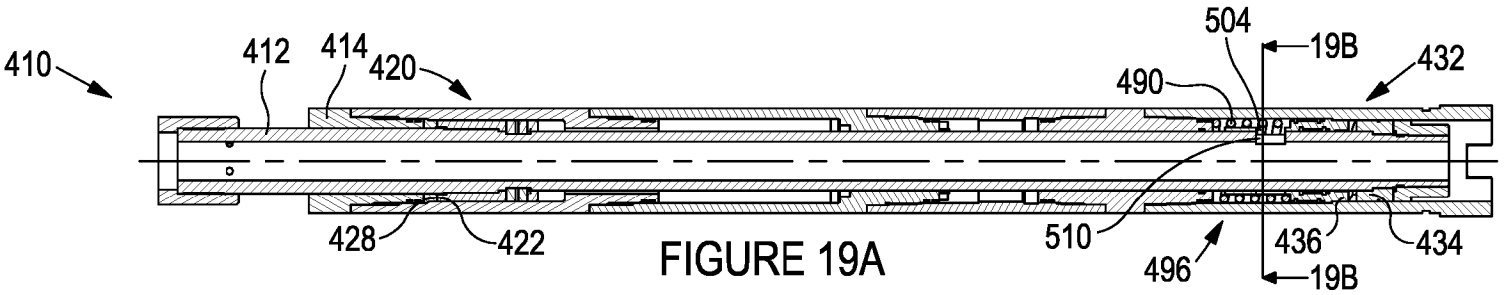
Figure 19B:
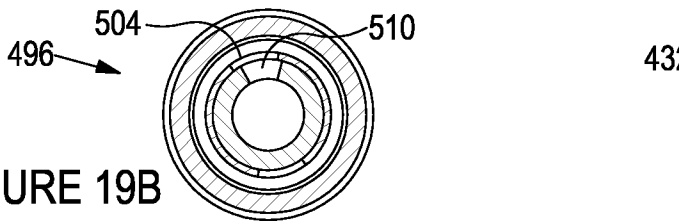
Figure 19C:
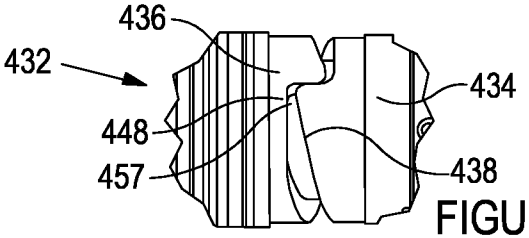

Reference is initially made to FIGS. 19A to 19C, wherein the apparatus 410 is illustrated in an initial configuration in FIG. 19A, the corresponding configuration of the valve assembly 496 is illustrated in FIG. 19B, which is a cross-section taken through line 19B-19B of FIG. 19A, and the corresponding configuration of the lifting mechanism 432 is illustrated in FIG. 19C. When in this initial position the housing 414 may be engaged with an object (not shown), such as an object stuck in a wellbore, which effectively causes the housing 414 to become fixed. The mandrel 412 is coupled to a drive structure, such as a work string (not shown), and is thus operated to rotate relative to the housing 414. An axial pulling force may be applied to the mandrel 412, for example via a work string, to apply axial preloading between the mandrel 412 and housing 414.

When in this initial configuration the impact surfaces 422, 428 of the impact mechanism 420 are engaged such that any initial pulling force applied to the mandrel 412 generates loading between said impact surfaces 422, 428, and thus between the mandrel 412 and the housing 414. The ports 504, 510 of the valve assembly 496 are aligned such that the valve 496 is in an open configuration and the shuttle cam 436 is thus axially released from the housing 414. Although the shuttle cam 436 may be considered to be axially released from the housing 414 when the valve assembly 496 is open, the shuttle cam 436 is nevertheless biased axially towards the fixed cam 434 by virtue of the spring 490.

As illustrated in FIG. 19C, the first and second cam profiles 438, 448 of the fixed and shuttle cams 34, 36 respectively are not engaged (separation gap 457).

Figure 20A:
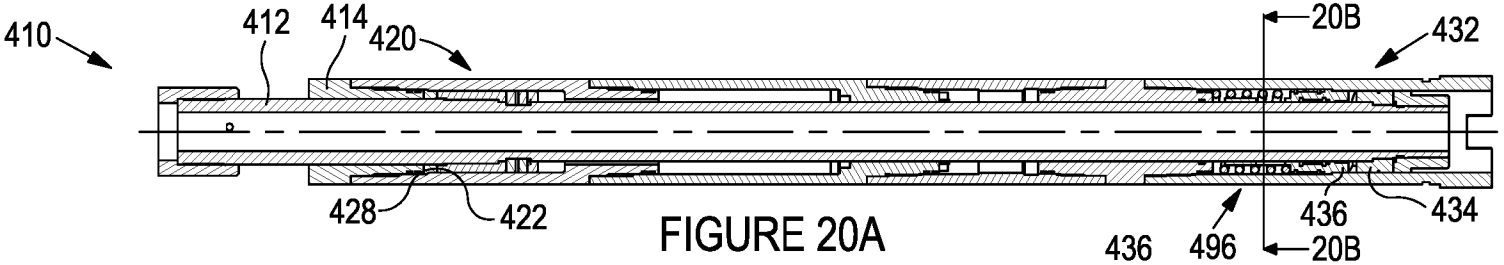
Figure 20B:
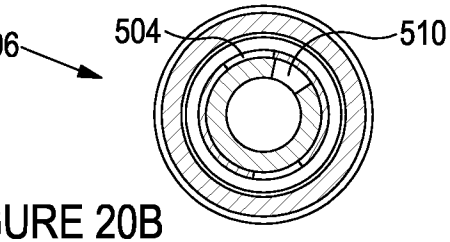
Figure 20C:
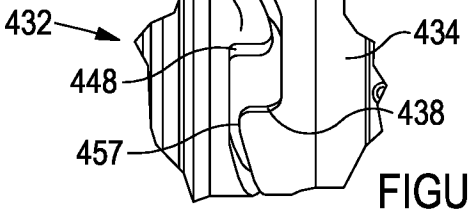

Rotation of the mandrel 412 relative to the housing 414 eventually causes the valve assembly 496 to close by misalignment of the ports 504, 510, as illustrated in FIGS. 20A and 20B, wherein FIG. 20B is a sectional view taken through line 20B-20B of FIG. 20A. The shuttle cam 436 thus becomes hydraulically locked relative to the housing 414. When in this configuration the fixed cam 434 has rotatably progressed, but the first and second cam profiles 438, 448 remain separated and non-engaged (separation gap 457).

Figure 21A:
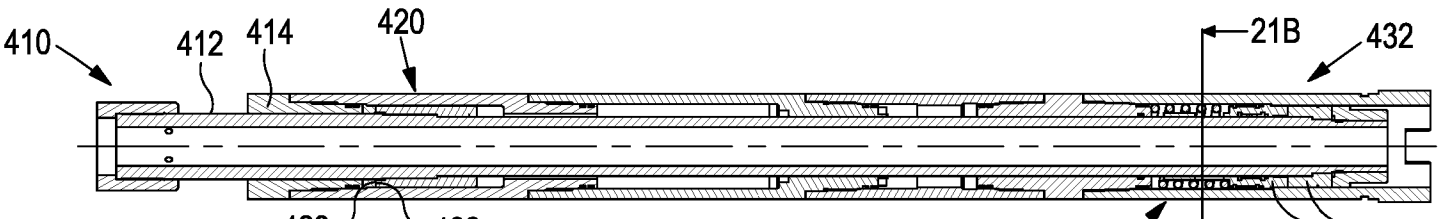
Figure 21C:
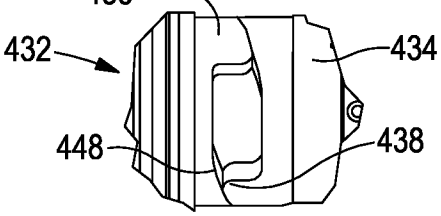
Figure 21B:
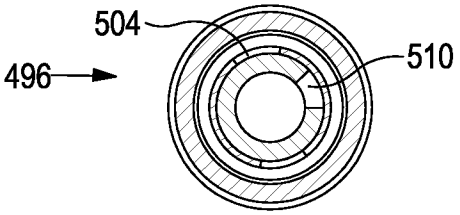

Continued rotation of the mandrel 412, illustrated in FIG. 21A, maintains the valve assembly 496 in its closed configuration, as illustrated in FIG. 21B, which is a sectional view taken through line 21B-21B of FIG. 21A, and eventually brings the cam profiles 438, 448 into engagement, as illustrated in FIG. 21C, in preparation to initiate the lifting phase. When in the configuration illustrated in FIG. 21A, the impact surfaces 422, 428 of the impact mechanism 420 remain engaged.

Figure 22A:
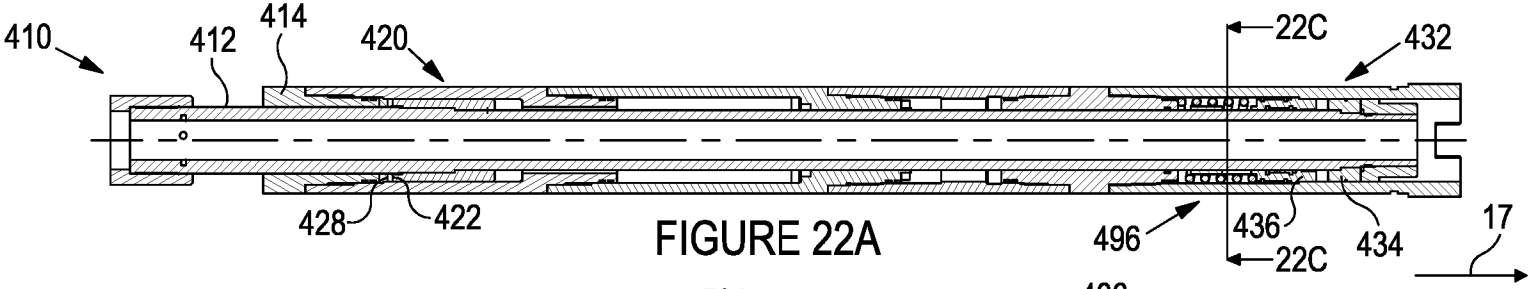
Figure 22D:
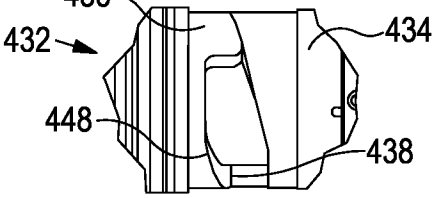
Figure 22C:
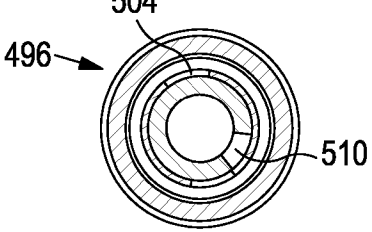
Figure 22B:
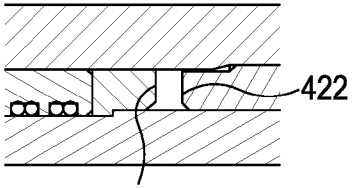

Further rotation of the mandrel 12, illustrated in FIG. 22A, maintains the valve assembly 496 in its closed configuration, as illustrated in FIG. 22C, which is a sectional view taken through line 22C-22C, and causes the first and second cam profiles 438, 448 of the fixed and shuttle cams 434, 436 to slide over each other and cause relative axial displacement of the cams 434, 436 to provide the lifting phase, as illustrated in FIG. 22D. By virtue of the shuttle cam 436 being hydraulically locked and axially fixed to the housing 414 the axial separation between the cams 434, 436 causes the mandrel 412 to be moved axially in the direction of arrow 17, causing the first and second impact surfaces 422, 428 to become axially separated, as also illustrated in the enlarged view of FIG. 22B. Such axial movement of the mandrel 412 generates potential energy between the mandrel 412 and housing 414.

Figures 23A, 23B, 23C, 24A, 24B, 24C:
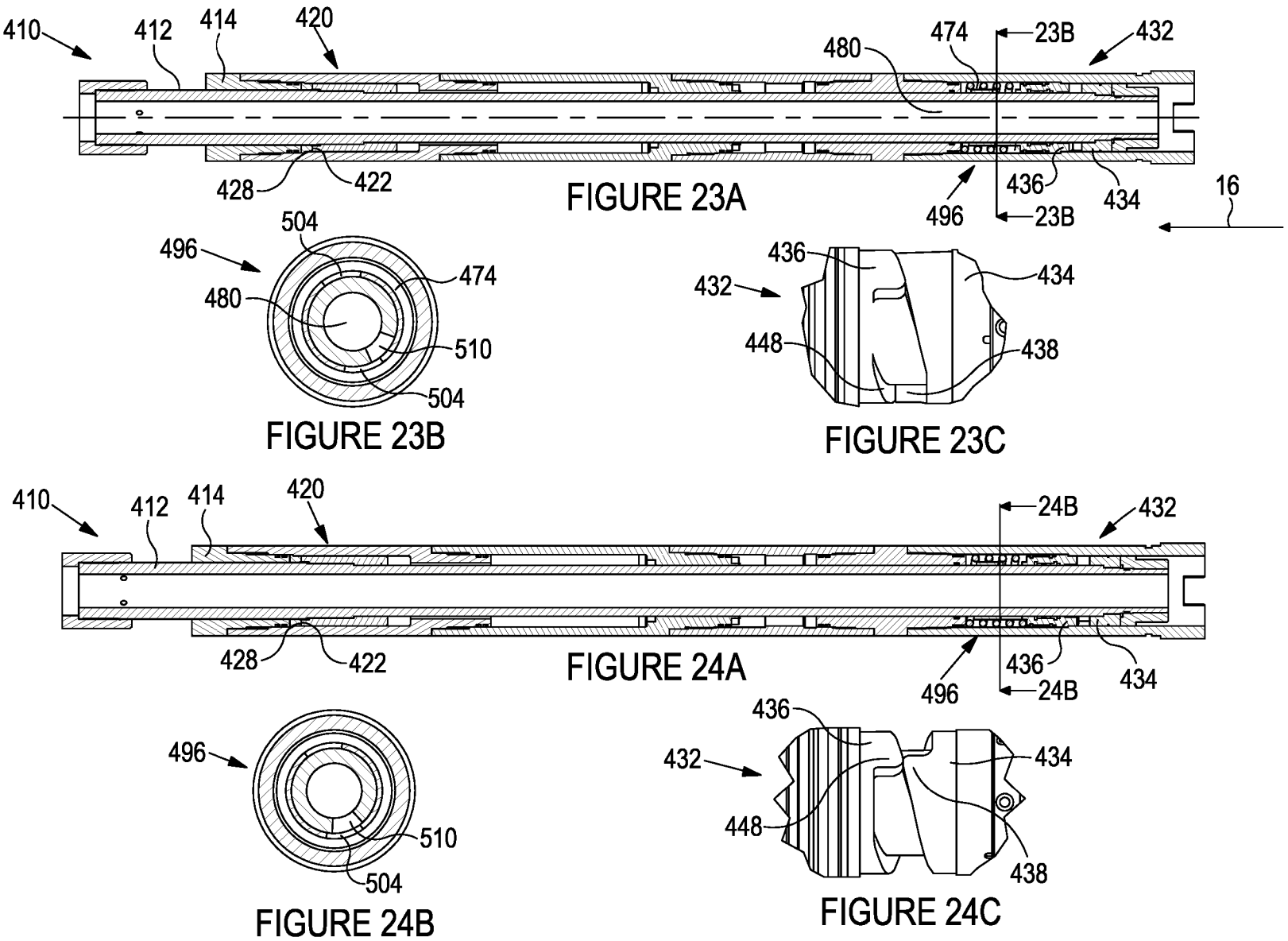

Further rotation of the mandrel 412, illustrated in FIG. 23A, causes the ports 504, 510 of the valve assembly 496 to start to become aligned, as illustrated in FIG. 23B, which is a sectional view taken through line 23B-23B, thus reconfiguring the valve assembly 496 into its open configuration. This establishes communication between the first and second hydraulic chambers 474, 480 and axially releases the shuttle cam 436 from the housing 414. This axial release of the shuttle cam 436 permits the loading and potential energy generated between the mandrel 412 and housing 414 to be rapidly relieved, causing mandrel 412 to axially move in the direction of arrow 16 and the first and second impact surfaces 422, 428 to be rapidly impacted together, generating a jarring force.

As illustrated in FIG. 23C, the ramp profiles 438, 448 of the fixed and shuttle cams 434, 436 remain engaged. However, the axial release of the shuttle cam 436 from the housing 414 relieves or reduces, for example significantly reduces, loading applied between the fixed and shuttle cams 434, 436, thus minimising stress therein.

The configuration of the apparatus 410 upon further rotation of the mandrel 412 is illustrated in FIG. 24A. As shown in FIG. 24B, which is a sectional view taken through lines 24B-24B in FIG. 24A, the valve assembly 496 remains opened, with the ports 504, 510 still aligned during this further rotation. The further rotation also causes the fixed cam 534 to further rotate relative to the shuttle cam 536, causing the ramp profiles 538, 548 to reach the peak position, as illustrated in FIG. 24C, reflecting the maximum axial separation between the cams 434, 436. As the valve assembly 496 remains open during this phase of rotation loading applied between the reducing contact area between the ramp profiles 438, 448 is minimised, thus minimising stresses within the cams 434, 436.

Further rotation of the mandrel 412 will cause the cams 434, 436 to effectively drop (i.e., the shuttle cam 436 "drops" relative to the fixed cam 434), returning the apparatus 410 to the initial configuration of FIG. 19A. Continuous rotation of the mandrel 412 will cause continuous cycles of jarring, as described above.

It should be recognised that the examples provided herein are indeed only exemplary, and that various modifications may be made thereto. For example, in the various apparatus described above a fixed cam of a lifting mechanism is associated with the mandrel and a shuttle cam is associated with the housing. However, this arrangement may be reversed. Such reversal of components may also be the case in relation to the valve assembly and/or the impact mechanism.

Furthermore, while the axial locking system 160 of apparatus 310 (Figured 15A and 15B) is provided by a mechanical arrangement, a fluid or hydraulic arrangement may alternatively or additionally be provided.

The invention claimed is:

1. A jarring apparatus, comprising:

first and second jarring assemblies rotatable relative to each other;

a first impact surface provided on the first jarring assembly and a second impact surface provided on the second jarring assembly, wherein, in use, the first and second impact surfaces are biased together; and a first lifting structure rotatably fixed relative to the first jarring assembly and a second lifting structure rotatably fixed relative to the second jarring assembly, the first and second lifting structures being configured to cooperate during relative rotation therebetween to cause cyclical relative displacement in one axial direction to define a lifting phase and relative displacement in a reverse axial direction to define a dropping phase, wherein the first and second lifting structures are axially fixed relative to their associated jarring assembly during the lifting phase to provide axial separation between the first and second impact surfaces, and the second lifting structure is axially released relative to the second jarring assembly prior to initiation of the dropping phase to permit the first and second impact surfaces to be axially impacted together.

2. The jarring apparatus according to claim 1, wherein loading between the first and second jarring assemblies is applied between the first and second lifting structures when the second lifting structure is axially fixed relative to the second jarring assembly, and axial release of the second lifting structure reduces loading applied between the first and second lifting structures prior to initiation of the dropping phase.

3. The jarring apparatus according to claim 1, wherein the second lifting structure is axially released relative to the second jarring assembly prior to completion of the lifting phase.

4. The jarring apparatus according to claim 1, wherein the first and second lifting structures comprise inter-engaging profiles which cooperate during relative rotation of the lifting structures to cause the cyclical lifting and dropping phases, the inter-engaging profiles being configured such that a surface area of contact therebetween reduces as the lifting phase progresses.

5. The jarring apparatus according to claim 4, wherein the inter-engaging profiles comprise rotary cam surfaces.

6. The jarring apparatus according to claim 4, wherein the inter-engaging profiles of the first and second lifting structures are prevented from axial engagement during or following the dropping phase.

7. The jarring apparatus according to claim 6, wherein the inter-engaging profiles remain separated during a portion of relative rotation between the first and second lifting structures following the dropping phase, and wherein the inter-engaging profiles are brought into contact to initiate a subsequent lifting phase.

8. The jarring apparatus according to claim 1, wherein the first lifting structure is permanently axially fixed relative to the first jarring assembly at least in a direction of loading applied between the first and second lifting structures.

9. The jarring apparatus according to claim 1, wherein one of the first and second jarring assemblies axially extends into the other of the first and second jarring assemblies.

10. The jarring apparatus according to claim 1, wherein the first and second lifting structures are radially interposed between the first and second jarring assemblies.

11. The jarring apparatus according to claim 1, comprising a locking system for selectively axially fixing and releasing the second lifting structure relative to the second jarring assembly.

12. The jarring apparatus according to claim 11, wherein the locking system is operated in response to relative rotational movement between the first and second jarring assemblies.

13. The jarring apparatus according to claim 11, wherein the locking system comprises a hydraulic locking system for hydraulically locking and releasing the second lifting structure relative to the second jarring assembly.

14. The jarring apparatus according to claim 13, wherein the hydraulic locking system, when locked, hydraulically locks a volume of hydraulic fluid axially between the second lifting structure and the second jarring assembly such that axial forces are transmitted between the second lifting structure and second jarring assembly via the hydraulically locked fluid.

15. The jarring apparatus according to claim 13, wherein the hydraulic locking system comprises a first hydraulic chamber, and is configured to:

lock hydraulic fluid within the first hydraulic chamber to hydraulically lock the second lifting structure relative to the second jarring assembly; and:

release the hydraulically locked fluid from the first hydraulic chamber to permit axial release of the second lifting structure relative to the second jarring assembly.

16. The jarring apparatus according to claim 15, wherein the hydraulic locking system comprises a valve assembly which is closed to hydraulically lock fluid within the first hydraulic chamber, and which is opened to release the hydraulically locked fluid from the first hydraulic chamber.

17. The jarring apparatus according to claim 16, wherein the valve assembly is selectively opened and closed by relative rotation between the first and second jarring assemblies.

18. The jarring apparatus according to claim 16, wherein the valve assembly comprises a first valve portion rotatably fixed relative to the first jarring assembly and a second valve portion rotatably fixed relative to the second jarring assembly such that relative rotation between the first and second jarring assemblies causes corresponding relative rotation between the first and second valve portions.

19. The jarring apparatus according to claim 18, wherein the first and second valve portions each comprise at least one port, wherein the ports are sequentially aligned and misaligned during relative rotation between the first and second valve portions.

20. The jarring apparatus according to claim 16, wherein the hydraulic locking system comprises a second hydraulic chamber and the valve assembly is interposed between the first and second hydraulic chambers, the valve assembly being configurable between open and closed configurations such that when the valve assembly is closed the first and second hydraulic chambers are isolated from each other, and when the valve assembly is open the first and second hydraulic chambers are presented in communication with each other.

21. The jarring apparatus according to claim 20, wherein the second hydraulic chamber is defined by a flow path through the jarring apparatus.

22. The jarring apparatus according to claim 20, wherein the second hydraulic chamber extends between the valve assembly and a moveable barrier, wherein the moveable barrier is biased in a direction to displace hydraulic fluid from the second hydraulic chamber into the first hydraulic chamber when the valve assembly is open to provide relative displacement between the first and second lifting structures during the dropping phase.

23. The jarring apparatus according to claim 1, wherein the first and second jarring assemblies are rotatable relative to each other when configured in a first mode of operation, and the first and second jarring assemblies are rotatably fixed relative to each other when configured in a second mode of operation.

24. The jarring apparatus according to claim 23, wherein the jarring assemblies are reconfigurable between the first and second modes of operation by relative axial movement therebetween.

25. A method for providing jarring, comprising:

providing a jarring apparatus which includes a first jarring assembly having a first impact surface and a first lifting structure rotatably and axially fixed relative to the first jarring assembly, and a second jarring apparatus having a second impact surface and a second lifting structure rotatably fixed relative to the second jarring assembly;

axially fixing the second lifting structure relative to the second jarring assembly;

establishing relative rotational movement between the first and second jarring assemblies to cause corresponding relative rotational movement between first and second lifting structures which cooperate to cause relative axial displacement in a lifting phase to cause axial separation between the first and second impact surfaces; and axially releasing the second lifting structure relative to the second jarring assembly to permit the first and second impact surfaces to be axially impacted together.

26. The method according to claim 25, wherein axially releasing the second lifting structure is performed by relative rotation between the first and second lifting structures.

27. The method according to claim 25, comprising, following axially releasing the second lifting structure, continuing relative rotational movement between the first and second jarring assemblies to cause reverse relative axial displacement in a dropping phase.

* * * * *